US008776423B2

(12) United States Patent
Paquette

(10) Patent No.: US 8,776,423 B2
(45) Date of Patent: Jul. 15, 2014

(54) ADJUSTMENT MECHANISM FOR HANDHELD WEAPONS

(71) Applicant: Joshua Paquette, Littleton, CO (US)

(72) Inventor: Joshua Paquette, Littleton, CO (US)

(73) Assignee: Battleline Industries, Inc., Littleton, CO (US)

( * ) Notice: Subject to any disclaimer, the term of this patent is extended or adjusted under 35 U.S.C. 154(b) by 40 days.

(21) Appl. No.: 13/657,528

(22) Filed: Oct. 22, 2012

(65) Prior Publication Data

US 2014/0109453 A1 Apr. 24, 2014

(51) Int. Cl.
*F41C 23/14* (2006.01)

(52) U.S. Cl.
USPC ..... 42/73

(58) Field of Classification Search
CPC ..... F41C 23/14
USPC ..... 42/73, 71.01, 72
See application file for complete search history.

(56) References Cited

U.S. PATENT DOCUMENTS

| | | | | |
|---|---|---|---|---|
| 4,896,446 | A * | 1/1990 | Gregory | 42/73 |
| 5,392,553 | A * | 2/1995 | Carey | 42/73 |
| 6,688,031 | B2 * | 2/2004 | Steele | 42/73 |
| 7,418,797 | B1 * | 9/2008 | Crose | 42/74 |
| 7,536,819 | B2 * | 5/2009 | Popikow | 42/74 |
| 7,810,270 | B2 * | 10/2010 | Fitzpatrick et al. | 42/73 |
| 2010/0212205 | A1 * | 8/2010 | Nill | 42/73 |

* cited by examiner

*Primary Examiner* — J. Woodrow Eldred
(74) *Attorney, Agent, or Firm* — Dorsey & Whitney LLP

(57) ABSTRACT

An adjustment mechanism selectively attachable to a rifle. The adjustment mechanism includes a riser body configured to be operably connected to a butt end of the rifle and a butt plate rotatably connected to the riser body. The butt plate is configured to be selectively rotated between at least a first position and a second position relative to the riser body. In some instances the butt plate attaches to a butt pad of the rifle and as the butt plate rotates between the first position and the second position, the butt pad rotates correspondingly. The adjustment mechanism also includes a cheek piece rotatably supported above the riser body and selectively rotatable relative to the riser body between a support position and a release position and in the support position the cheek piece extends along a top surface of the rifle and in the release position the extends along a side of the rifle.

17 Claims, 22 Drawing Sheets

ADJUSTMENT MECHANISM FOR HANDHELD WEAPONS

FIELD

The present invention relates generally to weapons, and more specifically to weapons accessories.

BACKGROUND

Many handheld weapons, such as rifles, may require various adjustments in order to be used comfortably by different users. For example, some precision rifles may include a scope or other view finder which may typically require the user to have his or her eyes at a certain level in order to best utilize the alignment tools of the scope or view finder. However, often the weapons themselves are not fully adjustable or do not have mechanisms that are easily and quickly adjustable. Accordingly, it may generally be difficult for users to share certain handheld weapons and/or alter the use of those weapons quickly (e.g., switching from long range to short range).

SUMMARY

Examples of embodiments described herein may take the form of an adjustment mechanism for a rifle. The adjustment mechanism may include a riser body configured to be operably connected to a butt end of the rifle, a butt plate rotatably connected to the riser body where the butt plate is configured to be selectively rotated between at least a first position and a second position relative to the riser body. The adjustment mechanism also includes a cheek piece rotatably supported above the riser body and selectively rotatable relative to the riser body between a support position and a release position, and in the support position the cheek piece extends along a top surface of the rifle and in the release position the extends along a side of the rifle.

Other examples of embodiments described herein may take the form of a rifle accessory configured to be selectively connected to a rifle. The rifle accessory includes a main body configured to be operably connected to the rifle and a cheek support having a length rotatably connected to the main body. The cheek support is rotatable between a first position and a second a position, and in the support position the length of the cheek support extends substantially parallel to a top surface of the rifle and in the release position the length of the cheek support extends substantially parallel to a side surface of the rifle.

In some embodiments the rifle accessory may further include a butt plate operably connected to the main body and the butt plate may be selectively rotatable relative to the main body. Additionally, the butt plate can be operably connected to the main body along a range of heights in order to alter the height of the butt plate relative to the rifle.

SPECIFICATION

Overview

In some embodiments herein, an adjustment mechanism or stock attachment member for handheld weapons is disclosed. The adjustment mechanism may be operably connected to a first or rear end of a handheld weapon, such as a rifle or other type of precision firearm, and may be configured to be operably connected to a variety of different weapons. The adjustment mechanism provides adjustments for a rifle or other weapon to allow a user to enhance his or her marksmanship skill set and personal fit for a particular weapon.

In some embodiments the adjustment mechanism may include a mounting plate, a cheek piece operably connected to a riser body, and a butt plate operably connected to the main body. The mounting plate operably connects the adjustment mechanism to the weapon, such as a rifle, and may be configured to match a configuration of the attachment end of the stock. In other words, the mounting or attachment plate may be varied depending on the desired weapon for which the adjustment mechanism may be attached, so that the adjustment mechanism may be operably connected to substantially any type of handheld weapon including a stock or elongated end member.

The cheek piece may be rotatably connected to the main body, which may operably connect to a first side of the mounting plate opposite the stock. The cheek piece may be a generally elongated member with an arcuate top surface, which may allow the cheek piece to conform to a user's cheek to comfortably provide a support surface for a user's cheek. The cheek piece may be rotated with respect to the main body and may also be vertically and/or horizontally adjustable relative to the main body. In this manner, the cheek piece may be positioned relative to the stock in substantially any position desired by the user to provide the desired eye-height elevation relative to the stock. In some embodiments, the cheek piece may rotate approximately 90 degrees in two directions relative to the main body.

The adjustment mechanism may also include a butt plate which may be operably connected to an end of the main body. The butt plate may selectively rotate relative to the main body, which may allow the butt plate to be adjusted to a particular angle as desired by the user. Additionally, the butt plate may be operably connected to the riser body at varying heights. The variations in the angle, height, and orientation of the butt plate may increase the comfort experienced by a user during use of the rifle. In some embodiments, the butt plate may be operably connectable to an end portion such as a butt pad of the weapon. In these instances, the adjustment mechanism may be positioned between the butt pad and the stock of the weapon. In these embodiments, the adjustment mechanism may have different connection mechanisms, shapes, and/or dimensions for the butt plate and/or mounting plate so as to be able to be operably connected to a variety of different rifle models, sizes, and shapes.

DETAILED DESCRIPTION

Figure 1A:
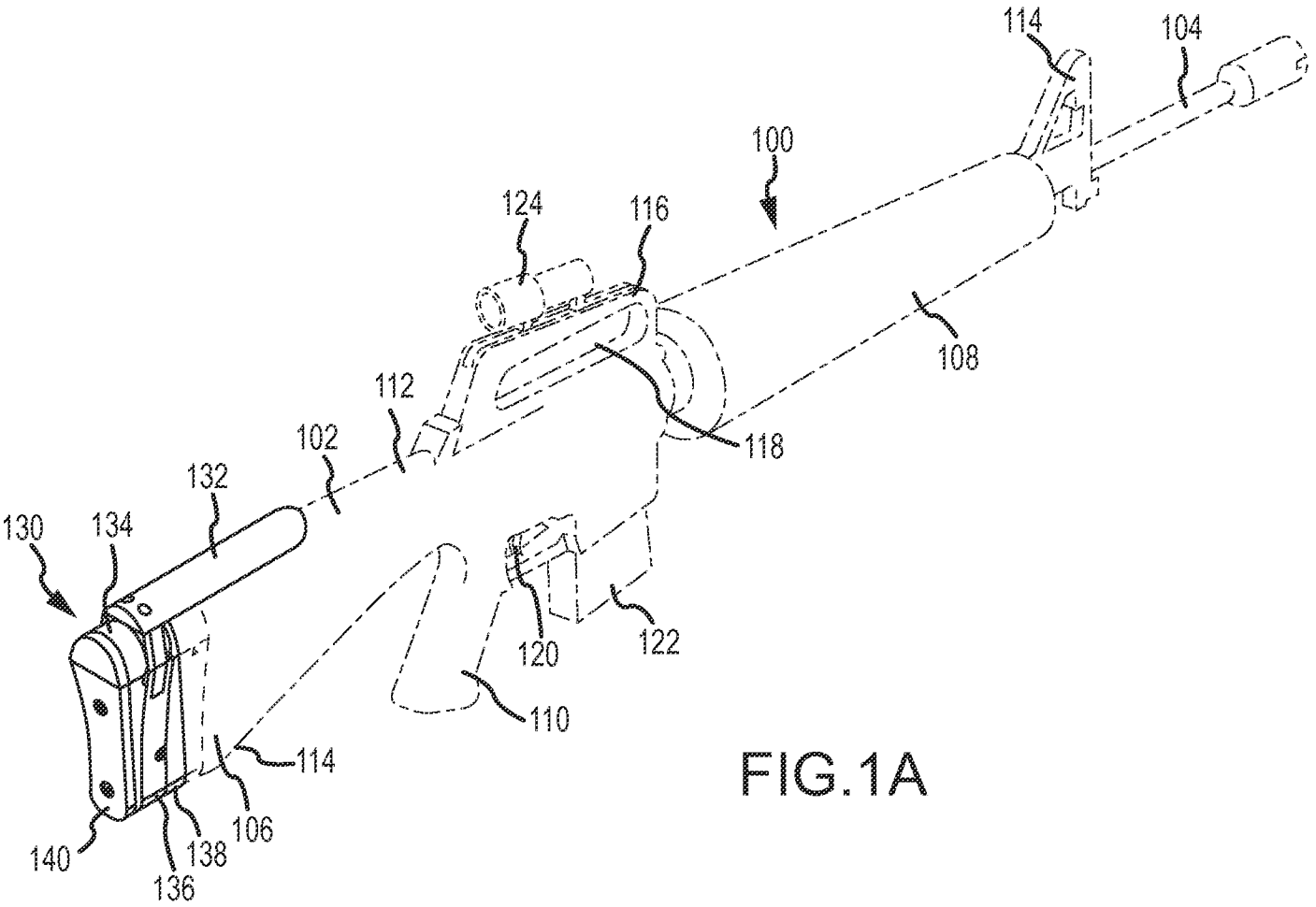
FIG. 1A is a perspective view of an adjustment mechanism operably connected to a rifle.
Figure 1B:
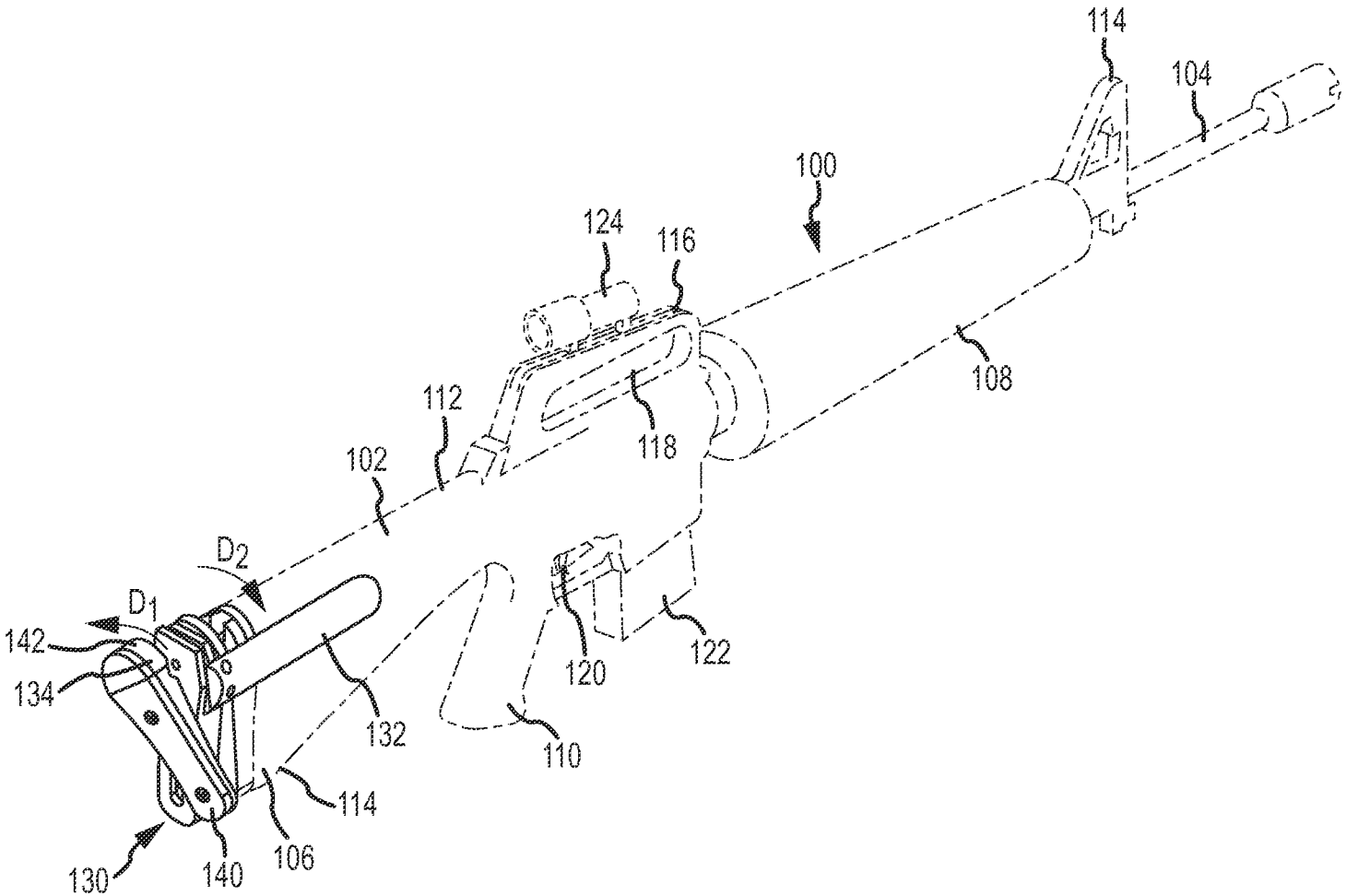
FIG. 1B is a perspective view of the adjustment mechanism operably connected to the rifle, with a cheek piece and a butt plate rotated to alternate positions from the positions shown in FIG. 1A.

Turning now to the figures, the adjustment mechanism will now be discussed in more detail. FIG. 1A is a perspective view of an adjustment mechanism operably connected to a stock of a rifle. FIG. 1B is a perspective view of the adjustment mechanism operably connected to the stock, with a cheek piece and a butt plate rotated relative to the stock. The rifle 100 may include a barrel 104, a forend 108, a stock 102, a grip 110, a butt 106, and a toe 114. Additionally, the rifle 100 may include one or more sights 114, 116 which may provide a visual indicator to allow a user to aim the barrel 104 at one or more objects. Further, the rifle 100 may include a trigger 120 which may be used to activate the rifle 100. It should be noted that although the handheld weapon illustrated in FIGS. 1A and 1B is a rifle, in other embodiments, the adjustment mechanism may be configured to be operably connected to other types of weapons, such as other handheld firearms or the like.

In some embodiments, the adjustment mechanism 130 may be configured to be operably connected to a rifle such as a M4 carbine or rifle including a weapons platform utilizing an AR-15 style carbine stock/buffer tube adapter. However, the adjustment mechanism 130 may be used with substantially any other type of handheld ammunition based weapon.

The stock 102 may provide a main gripping area for a user, and as such, the grip 110 may extend from a bottom surface of the stock 102. Depending on the rifle 100, the stock 102 may have a frustum shape, with the larger portion of the frustum extending into the butt 106 of the rifle and then narrowing towards the barrel 104. The grip 110 may extend downwards from a bottom surface of the stock 102 at an angle in order to be positioned towards a user to provide a more comfortable gripping position. The butt 106 may extend from a first end of the stock 102 and may form a rear end of the rifle 100, with the toe 114 forming a bottom edge of the rifle 100. A top surface of the stock 102 may extend upwards to form a comb 112 of the rifle 112 and the second sight 116 may extend from the comb 112.

The second sight 116 may be include a groove or other element which may allow a user to align a tip of the first sight 114 within the groove to aim the rifle Additionally the second sight 116 may provide a connection location for a scope 124 or optic which may be separate from or integrated into the rifle 100. For example, as shown in FIGS. 1A and 1B, the second sight 116 may include a main body defining an aperture 118, and the scope 124 may be operably connected to the main body.

Extending from a front end of the comb 112 is the forend 108, which may be operably connect to the barrel 104 and the first sight 114. The rifle 100 may also include a trigger 120 which may be used to activate the rifle 100 and to fire ammunition stored within the ammunition magazine 122 through the barrel 104.

It should be noted that although a rifle 100 is shown in FIGS. 1A and 1B, the adjustment mechanism, as discussed herein, may be used with substantially any other type of handheld weapon or firearm. Further, the adjustment mechanism may be used with non-weapon systems, such as paintball guns, AirSoft guns, air powered fire arms, or other similar devices.

The adjustment mechanism 130 is selectively connected to rifle 100 and may be attached to the stock 102 and substantially aligned with the butt 106. For example, as shown in FIGS. 1A and 1B, the adjustment mechanism 130 may be operably connected to the rifle 100 so as to extend from a rear surface of the butt 106. The adjustment mechanism 130 may include a cheek piece 132, a butt plate 134, and a mounting plate 138. The cheek piece 132, as will be discussed in more detail below, may be positioned so as to be substantially parallel with the stock 102 and may be rotated relative thereto. The butt plate 134 may also be rotated relative to the stock 102. Additionally, both the butt plate 134 and the cheek piece 132 may be connected along various heights relative to the adjustment mechanism. In this manner, a user may manipulate the adjustment mechanism 130 in various manners to allow a user to customize the rifle 100 to his or her preferred arrangements.

With reference to FIG. 1B, the butt plate 134 and the cheek piece 132 are shown rotated into alternative orientations from those illustrated in FIG. 1A. Specifically, the butt plate 134 has been rotated in a first direction D1 relative to the butt 106 of the rifle 100 and is oriented so a top end 142 extends away from the rifle 100 along a left side of the rifle 100. The cheek piece 132 is shown rotated in a second direction D2 relative to the rifle 100. The cheek piece 132 is moved from a support position on top of the stock 102 to a second position along a right side of the rifle 100. As will be discussed in more detail below, the exact rotation directions, positions, and orientations may be varied as desired by the user, based on the type of rifle 100, or the like.

Figure 2A:
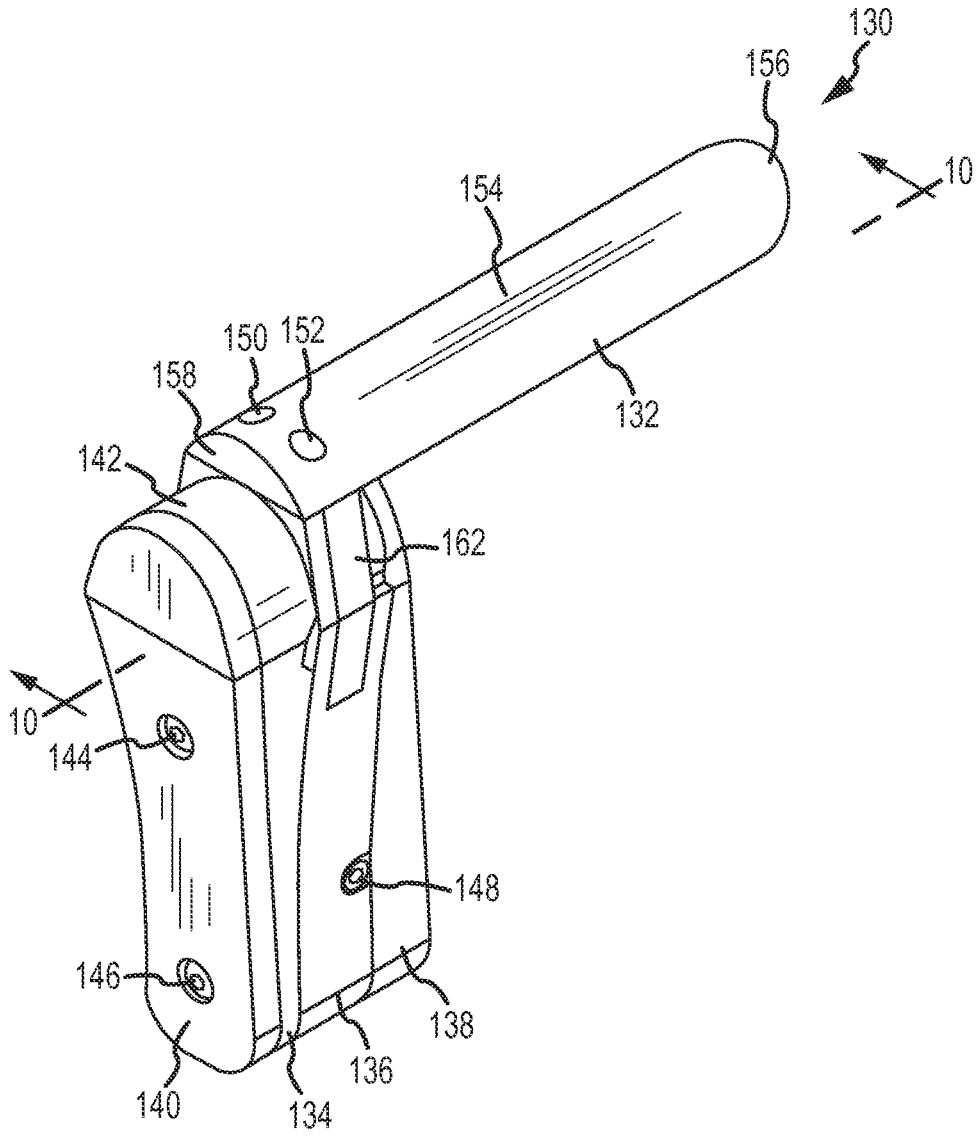
FIG. 2A is a rear perspective view of the adjustment mechanism.
Figure 2B:
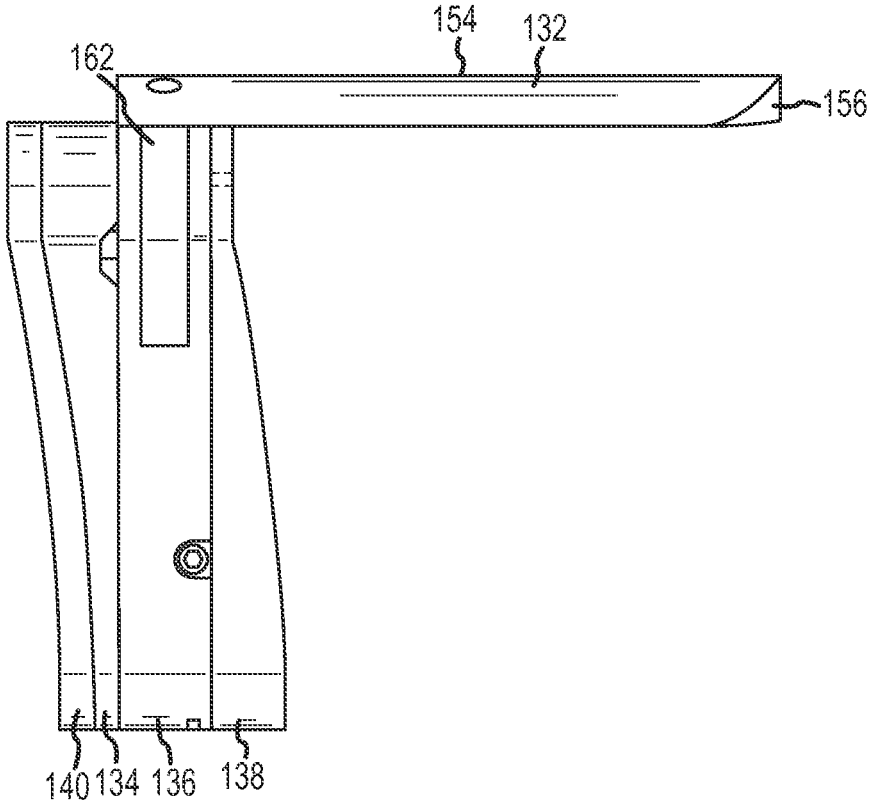
FIG. 2B is a side elevation view of the adjustment mechanism.
Figure 2C:
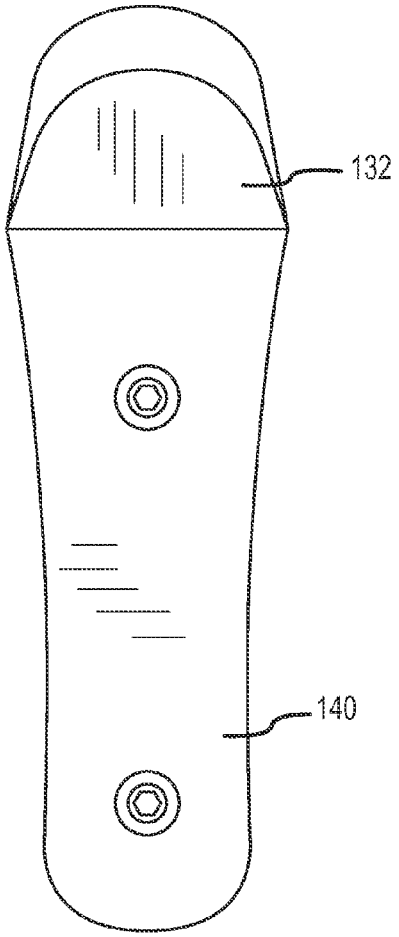
FIG. 2C is a rear elevation view of the adjustment mechanism.
Figure 2D:
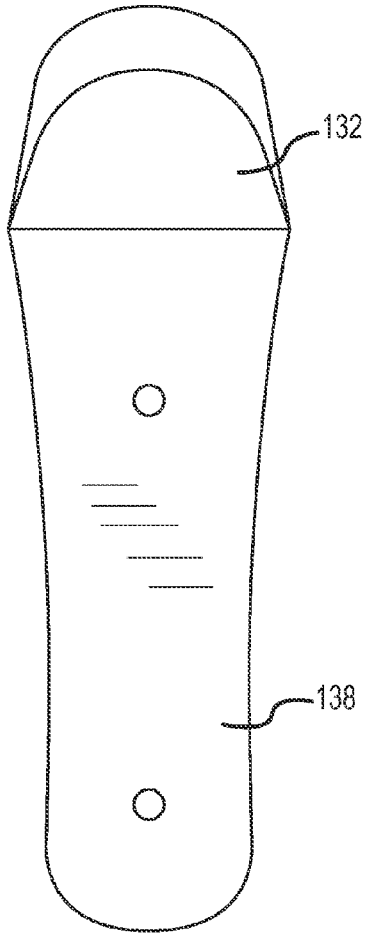
FIG. 2D is a front elevation view of the adjustment mechanism.
Figure 3:
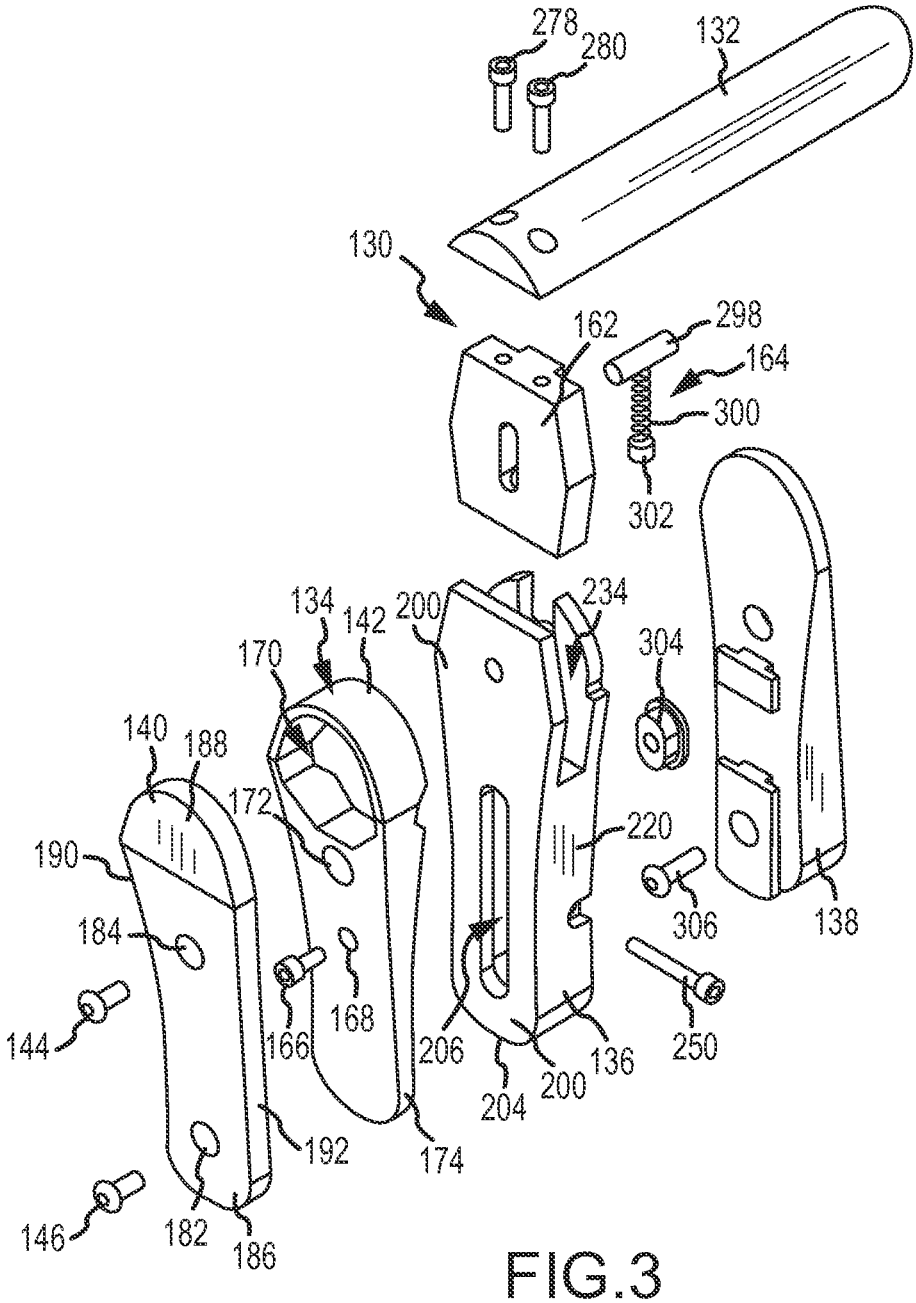
FIG. 3 is an exploded view of the adjustment mechanism.

The adjustment mechanism 130 will now be discussed in more detail. FIG. 2A-2C illustrate various views of the adjustment mechanism 130. FIG. 3 is an exploded view of the adjustment mechanism 130. The adjustment mechanism 130 may include the cheek piece 132, the butt plate 134, a riser body 136, and the mounting plate 138. Additionally, as shown in FIGS. 2A and 2B, a butt pad 140 may be operably connected to the butt plate 134. In many instances, the butt pad 140 may be part of the rifle 100, separate from the rifle 100, or in other instances may be included as part of the adjustment mechanism 130. The butt plate 134 and/or butt pad 140 may be rotatably connected to the riser body 136 and may be configured to rotated relatively thereto. Similarly, the cheek piece 132 may be configured to rotate relative to the riser body 136. The mounting plate 138 is operably connected to the riser body 136 and is configured to operably connect the attachment mechanism 130 to the butt 106 of the rifle 100.

With reference to FIG. 3, the butt plate 134 may be sandwiched between the butt pad 140 (if included) and the riser body 136. The butt plate 134 is configured to support the butt pad 140 and generally, during use of the rifle, the butt plate may be pressed against a user's shoulder (or other body areas) while a user is aiming or firing the rifle 100.

The butt pad 140 may include one or more apertures 182, 184 to receive fasteners 144, 146 for securing the butt pad 140 to the butt plate 134. The butt pad 140 may be generally elliptical or oval shape, or may otherwise track the shape of the butt 106. The butt pad 140 may include cushioning or padding, such as foam, or gel, which may be used to cushion the weight of the rifle 100 as it is pressed against the shoulder of a user. In instances where the butt pad 140 is including in the rifle 100 assembly, the butt pad 140 may be disconnected from the butt 106 and the adjustment mechanism 130 may be connected to the butt 106 and then the butt pad 140 may be connected to the butt plate 134. In this manner, the adjustment mechanism 130 may be essentially positioned between the butt pad 140 and the butt 106 of the rifle. These embodiments may allow the adjustment mechanism 130 to maintain the characteristics of the butt or rear end of rifle 100 because the butt pad 140 may be the same shape as the butt 106 and may include the desired padding amount, and so on.

It should be noted that in other embodiments, the butt pad 140 may be separate from the rifle 100. In these instances, the butt pad 140 may vary the shape, cushioning, or the like as originally provided by the rifle 100 butt 106 or included butt pad. In these instances, the adjustment mechanism 130 may provide further customization for a rifle 100. In these embodiments, the butt pad 140 may be integrally formed with the butt plate 134 or may be substantially permanently attached.

With reference again to FIG. 3, the butt pad 140 may have a generally elliptically shaped body with a top end 188 that may be slightly wider than the bottom end 186. A right side of the butt pad 140 may extend upwards from the bottom end 186 in a substantially straight manner, such that a first edge 192 may be relatively straight, until towards the top end 188, as the edge 192 may curve to form the rounded or arcuate top end 188. The opposite edge 190 may be contoured rather than substantially straight as it extends between the two ends 186, 188. For example, the edge 190 may curve inwards to form a soft "C" or other curve shape. Towards the top end 188, the edge 190 may briefly straighten before transitioning to form the arcuate shape of the top end 188.

The butt pad 140 may include one or more apertures 182, 184 defined therein which may be used to receive one or more fasteners 144, 146 that secure the butt pad 140 to the butt plate 134. However, other attachment mechanisms may be used, such as, but not limited to, hook and loop, attachment fingers or other members, hooks, snaps, and so on. Accordingly, depending on the desired attachment mechanism, the one or more apertures 182, 184 may be omitted, positioned in other locations, and/or increased in number. The attachment mechanisms may be selected based on the attachment mechanisms used for the butt 106 of the rifle 100.

With reference to FIGS. 2A, 2B, and 3, the butt plate 134 may operably connected between the butt pad 140 and the riser body 136 of the adjustment mechanism 130. The butt plate 134 is rotatably connected to the riser body 136 and may rotate relative to the rifle 100. The butt pad 140 may be non-rotatably connected to the butt plate 134, such that as the butt plate 134 rotates relative to the riser body 136, the butt pad 140 may rotate as well. In this manner, the cushioning provided by the butt pad 140 may be adjusted to a desired location by the user. It should be noted that in other embodiments, the butt pad 140 may rotatably connected to the butt plate 134 and the butt plate 134 may be non-rotatably connected to the riser body 136, in these instances, the butt pad 140 alone may be rotated as desired.

In conventional rifles 100, if they include a butt pad 140, the butt pad is not typically adjustable relative to the butt 106 of the rifle 100. Accordingly, the user may not be able to customize the angle, height, location, or the like of the cushioning provided by the pad. In these instances, a certain rifle may be uncomfortable for a user to position against his or her shoulder and/or the rifle 100 or may prevent the user from correctly aligning the rifle with a target. However, because the adjustment plate 134 allows the butt plate 140 to rotate therewith or rotate relative thereto, the user may be able to fully adjust the cushioning provided by the butt pad 140, as well as best angle the butt pad 140 to provide maximum desired comfort.

Figure 4A:
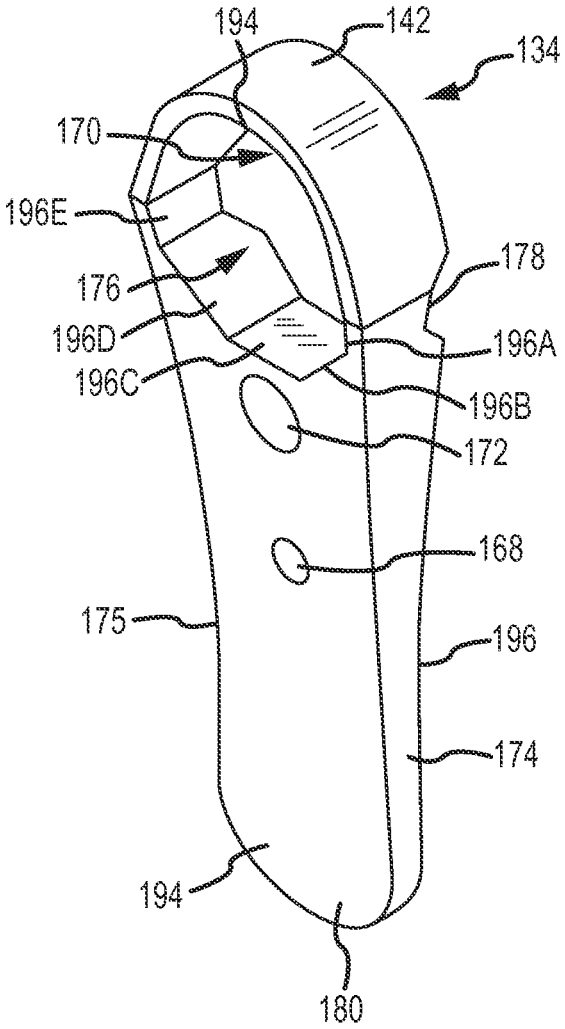
FIG. 4A is a front perspective view of the butt plate of the adjustment mechanism.
Figure 4B:
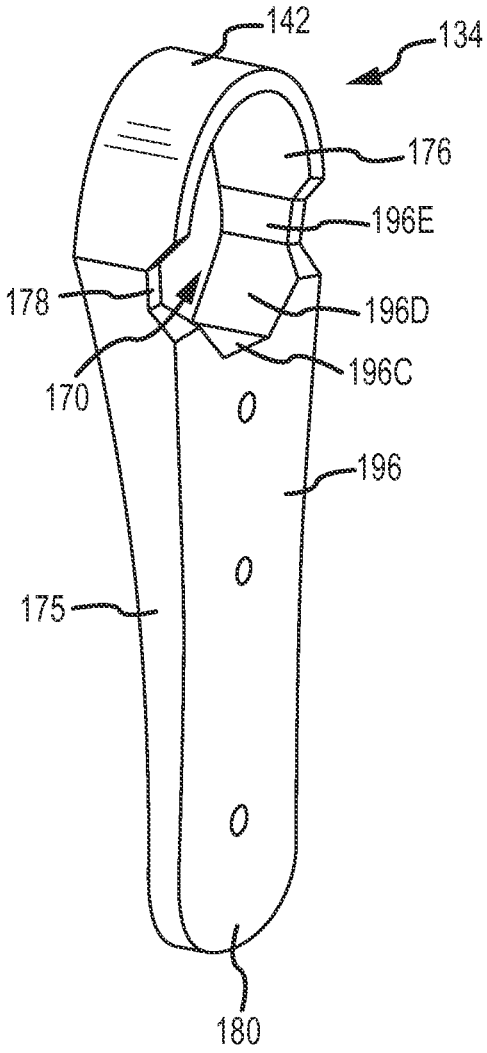
FIG. 4B is a rear perspective view of the butt plate of FIG. 4A.

The butt plate 134 may generally be configured to match a shape of the butt pad 140. FIG. 4A is a front perspective view of the butt plate 134. FIG. 4B is a rear perspective view of the butt plate 134. The butt plate 134 may have a generally elliptically shaped body with a top end 142 and a bottom end 180. Although, it should be noted that the butt plate 134 may be varied in shape, dimensions, and connection mechanisms based on the butt pad. In some instances, the bottom end 180 or the butt plate may be narrower than the top end 142, such that the butt plate 134 may expand outwards as it transitions from the bottom end 180 towards the top end 142. Additionally, the thickness of a first edge 174 and a second edge 175 may increase towards the top end 142. For example the first edge 174 may have a first thickness T1 towards the bottom edge 188 and a second thickness T2 towards the top edge 142, where the first thickness T1 may be smaller than the second thickness T2. In other embodiments, see for example FIG. 13, the butt plate 134 may have a substantially constant thickness along its height.

The butt plate 134 may also include a front or first surface 194 and a rear or second surface 196. The front surface 194 is aligned against a back surface of the butt pad 140 and may be configured to substantially match the shape and/or angle of the back surface of the butt pad 140. Depending on the rifle 100 as well as the butt pad 140, the front surface 194 may be modified so as to match the different shapes, sizes, and/or angles of the rifles/butt pads of different models, manufactures, and so on.

The butt plate 134 may include one or more fastening apertures 168, 172 defined therein. The fastening apertures 168, 172 receive one or more fastening members. A top fastening aperture 172 may be defined below the top end 142 portion of the butt plate 134, and may be configured to receive fastener 144, which may be used to operably connect the butt pad 140 to the butt plate 134. A bottom aperture 168 may be defined near a center line of the butt plate 184, below the top aperture 172. In some embodiments, the bottom aperture 168 may receive an attachment fastener 166, which may be used to rotatably connect the butt plate 134 to the riser body 136.

With continued reference to FIGS. 4A and 4B, the butt plate 134 may also include a butt aperture 170. The butt aperture 170 may help to reduce the weight of the butt plate, as well as may be configured to correspond to the butt pad shape. The butt aperture 170 may be defined in the butt plate 134 between the top aperture 172 and the to end 142. The butt aperture 170 may be substantially any shape, but in some instances may define a top sidewall 194 having a rounded shape, and a bottom sidewall 176 may be stepped or otherwise angled. For example, at a first side of the butt aperture 170, the first portion of the wall 196A may be relatively parallel to the first edge 174 and may then be angled towards a center of the butt plate 134 to form the second portion 196B, the wall 176 may then angle to form the third portion 196C that may be substantially perpendicular to the first portion 196A. From the third portion 196C, the wall 176 may transition at an angle upwards towards the second edge 175 and then flatten out to be more aligned with the second edge 175 and forming the fifth portion 196E. However, in other embodiments, the butt aperture 170 may be substantially any other shape, which may be symmetrical or asymmetrical, or a combination of both.

The first surface 194 and the second surface 196 of the butt plate 134 may generally be substantially the same; however, in some embodiments, the second surface 196 may include an alignment indent 178. The indent 178 is to assist the butt pad into snap fitting or otherwise operably connecting into place on the upper portion. The alignment indent 178 may be a depression formed along the butt plate 134 adjacent the first edge 175, and may decrease the thickness of the first edge 175 at that location. In some embodiments, the alignment intent 178 may be a generally triangularly shaped valley depressed into the second surface 196.

Figure 5A:
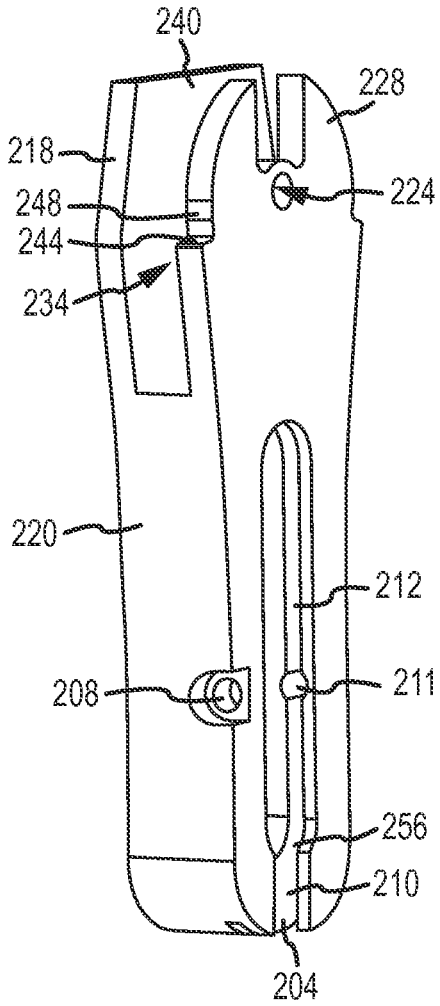
FIG. 5A is a rear perspective view of a riser body of the adjustment mechanism.
Figure 5B:
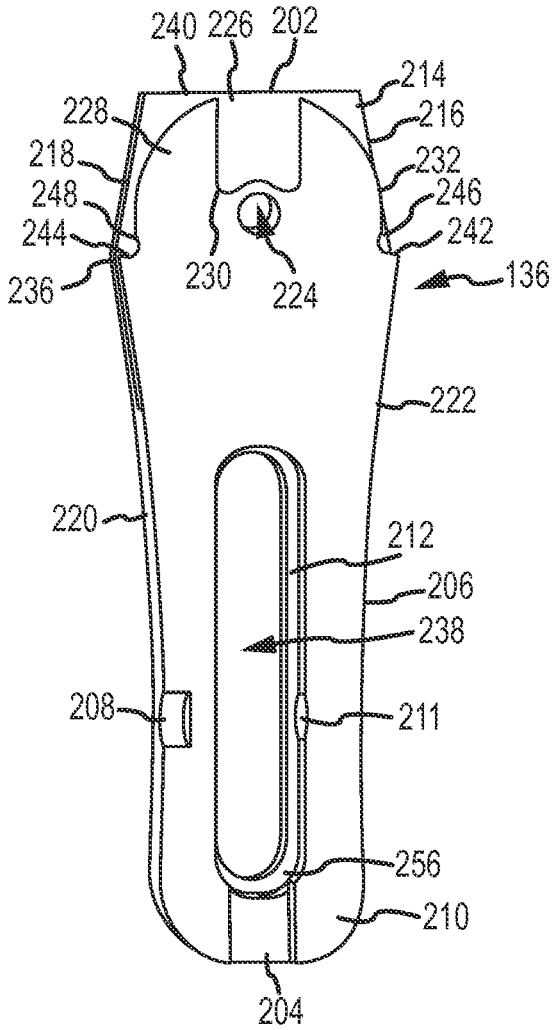
FIG. 5B is a front perspective view of the riser body of FIG. 5A.

Referring again to FIGS. 2A-3, the riser body 136 may be positioned between the butt plate 134 and the mounting plate 136. The riser body 136 may form the main body of the adjustment mechanism 130 and may rotatably support the cheek piece 132 and the butt plate 134. FIG. 5A is a rear perspective view of the riser body 136. FIG. 5B is a rear elevation view of the riser body 136. The riser body 136 has a front side 200 and a rear side 202, the front side 200 may be differently shaped from the rear side 202. For example, the front side 200 may have a generally elliptically surface that may transition towards a top end 202 to form a frustum shape, whereas the rear side 202 may have a generally elliptical shaped surface that transitions towards the top end 202 to form a wrench-like rotation support member 228. In this manner, the first side 200 may act as an alignment and attachment surface for the butt plate 134, and may at least partially match a shape of the butt plate 134, so that when the butt plate 134 is in its aligned position (see FIG. 1A), the butt plate 134 and riser body 136 may be aligned. In this manner, the adjustment mechanism 130 may have a more aesthetically pleasing appearance, as well as smooth gripping transition from a butt of the rifle 100 to the butt pad 140.

With reference to FIGS. 3, 5A, and 5B, the riser body 136 may define an adjustment cavity 234 towards the top end 202. The adjustment cavity 234 receives a rotation block 162, and as will be discussed in more detail below, the rotation block 162 rotates within the adjustment cavity 234 to vary a position of the cheek piece 132. The adjustment cavity 234 may be defined by the first side 200 and the second side 202, such that the adjustment cavity 234 may be defined only on two sides. In other words, the first and second sidewalls 220, 222 of the riser body 136 may terminate at a bottom edge of the adjustment cavity 234.

The front side 200 may extend from a rounded bottom end 204 upwards in a generally straight manner and at a first inflection point 238 (which may be slightly below a centerline of the riser body 136), the front side 200 may expand outwards, such that an upper portion of the front surface may have a larger width than the bottom portion. At a second inflection point 236 the front side 200 may taper inwards, forming the frustum 228 top portion 202. In some embodiments, edges 216, 218 of the front side 200 may be curved between the two inflection points 236, 238, but may straighten towards the respective top or bottom ends after each inflection point. However, in other embodiments, other shapes and transitions are envisioned.

With reference to FIGS. 5A and 5B, the second side 202 may generally correspond to shape and dimensions of the first side 200 until the second inflection point 236. In other words, the second side 200 may have a generally elliptically shaped bottom portion and at the first inflection 238 point may extend outwards at a slight curve or "C" shape. However, at the second inflection point 238, the second side 202 may form a shoulder 242, 244 along each edge. From the shoulders 242, 244 the rear side 202 may define a detent 246, 248 on either edge, and then extend upwards in a curved manner on either side to form a rotation support element 228. The rotation support element 228 forms a top portion of the second side 202 and has a rounded or curved shape that curves from the outer edge of the second side 202 towards the middle of the riser body 136.

The second side 202 may also include a lowering aperture 226 defined within the rotation support element 228. The lowering aperture 226 may be a generally rectangular aperture 226 defined within the second side 202 with an interlocking or alignment shape towards a bottom edge. For example, with reference to FIG. 5B, a bottom edge of the lowering aperture 226 may have two rounded features 232 that extend further down towards the bottom end 204 of the riser body 136. The interlocking shape of the lower aperture 226 may be configured to receive a locking element of the rotation block 162, discussed in more detail below. Thus, the lowering aperture 226 may be configured to correspond to the shape of the locking element, or may be otherwise configured and the shapes illustrated in FIGS. 5A and 5B are illustrative only.

The second side 202 may also include an encompassing recess 210 that may receive a portion of the mounting plate 138. The encompassing recess 210 may be depressed from a top surface of the second side 202 and a portion of the mounting plate 138 may be received therein when the adjustment mechanism 130 is assembled. The encompassing recess 210 may be a generally rectangular shaped recess that may extend around a centerline of the first side 202 from the bottom end 204 upwards. However, the encompassing recess 210 may be positioned substantially anywhere along the second side 202 and may be shaped in substantially any manner.

Figure 5C:
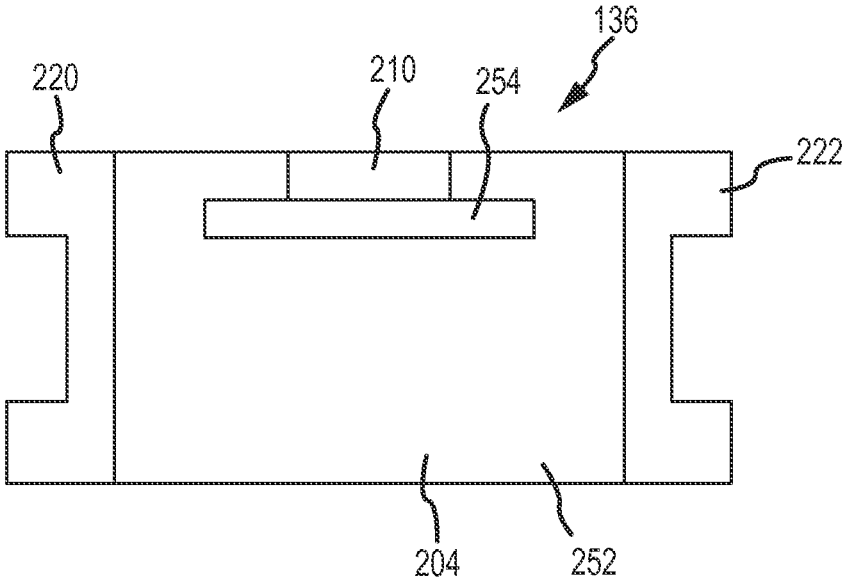
FIG. 5C is a bottom elevation view of the riser body of FIG. 5A.

With reference to FIG. 5C, the encompassing recess 210 may extend along the bottom surface 252 of the riser body 136 to form a T-shaped recess 254. The encompassing recess 210 and the T-shaped recess 254 may cooperate to help align the riser body 136 and the mounting plate 138, as well as secure the two plates together.

Further, the second side 202 may include a fastener recess 208 configured to receive at least a portion of a fastener. The fastener recess 208 may be positioned along either edge of the second side 202; however, in some embodiments, the fastener recess 208 may be positioned adjacent the first sidewall 220. With reference to FIG. 3, the fastener recess 208 receives fastener 250 which may operably connect the riser body 136 and the mounting plate 138. Additionally, the sidewalls of the adjustment aperture 206 may also include a recess 211 for receiving a portion of the fastener 250.

With reference again to FIGS. 3, 5A, and 5B, the riser body 136 may define an adjustment aperture 206. The adjustment aperture 206 may extend from the first side 200 through to the second side 202 and is configured to receive fastener 166. The fastener 166 may be received through the aperture 206 and extend to operably connect to the T-nut 304. The adjustment aperture 206 may have a larger width on the second side 202 as compared to the width on the first side 200. The width differential between the two sides 200, 202 may define a shelf 256 along a sidewall of the adjustment aperture 206. The shelf 256 may assist in securing the fastener 166 to the riser body 136 using T-nut 304.

The adjustment aperture 206 may have a generally oval shape which may extend along a height of the riser body 136. A height of the adjustment aperture 206 corresponds to a range of height adjustment for the butt plate 134 and/or butt pad 140. This is because the adjustment aperture 206 is configured to receive and operably secure the fastener 166 at substantially any location along its height, e.g., via the T-nut 304.

The riser body 136 may also include a locking aperture 246. The locking aperture 246 may be defined through both sides 200, 202 and may be positioned below and between the rounded features 232 of the lower aperture 226. The locking aperture 246 may be circular shaped and configured to receive a portion of a biasing member 164, discussed in more detail below.

Figure 6A:
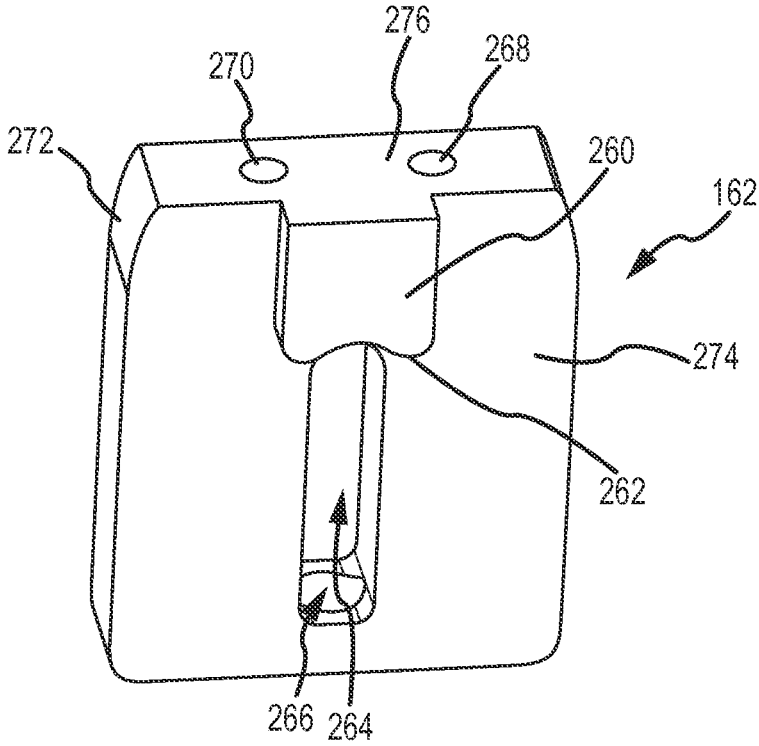
FIG. 6A is a front top perspective view of a rotation block of the adjustment mechanism.
Figure 6B:
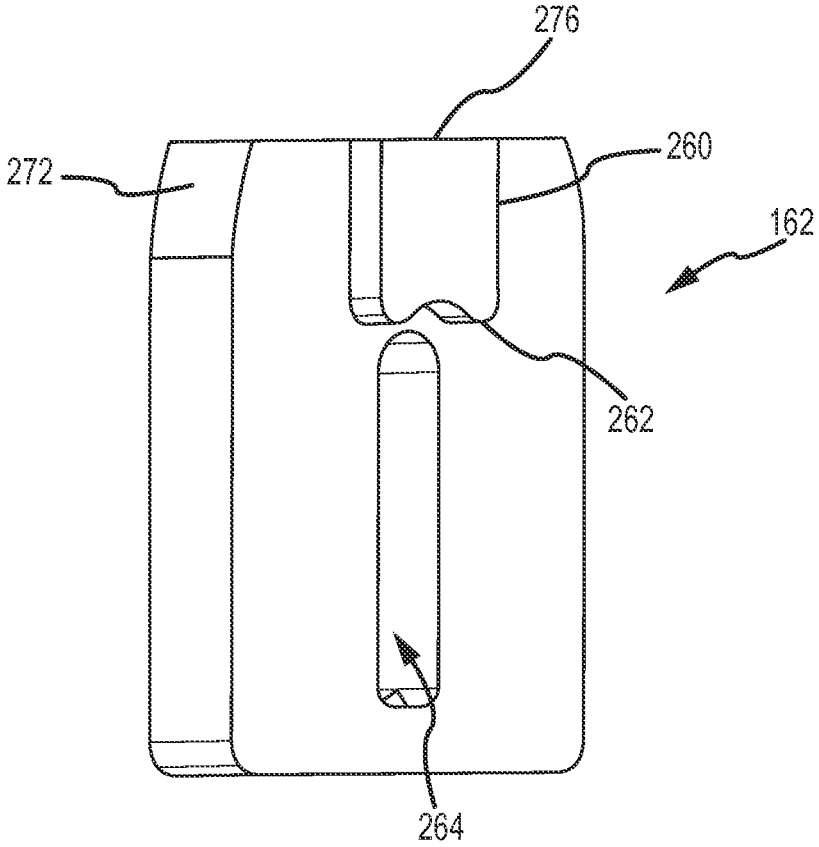
FIG. 6B is a side perspective view of the rotation block of FIG. 6A.

With reference again to FIG. 3, the cheek piece 132 may be rotatably connected to the riser body 136 by the rotation block 162. FIG. 6A is a rear perspective view of the rotation block 162. FIG. 6B is a side perspective view of the rotation block 164. The rotation block 162 is received into the adjustment cavity 234 defined in the top portion of the riser body 136. The rotation block 162 may be biased by the biasing member 164 into the adjustment cavity 234, but with sufficient force can be lifted and rotated relative to the riser body 136. Actuation of the rotation block 162 will be discussed in more detail below. In some embodiments, the rotation block 162 may be formed as an integral member with the cheek piece 132. For example, the rotation block 162 may be manufactured as an integral member with the cheek piece. Alternatively, the rotation block 162 may be formed separate from the cheek piece and operably connected thereto.

The rotation block 162 may include a locking member 260 that extends from a rear side 274. The locking member 260 may be oriented just below the top surface 276, substantially in a middle portion of the rotation block 162, and may extend about a fourth of the height of the rotation block 162. The locking member 260 is configured to be received into the lowering aperture 226 of the riser body 136. Accordingly, the locking member 260 may be configured to generally match the shape of the lowering aperture 226. For example, the locking member 260 may include two interlocking members 262 configured to be received into the rounded features 232 of the lowering aperture 226. In some embodiments, when the interlocking members 262 are received into the rounded features 232, the rotation block 162 may be substantially prevented from rotating relative to the riser body 136. In these embodiments, the rotation block 162 may have to be pulled upwards away from the riser body 136, in order to be rotated relative thereto. As will be discussed in more detail below, this may help to stabilize the cheek piece 132 when it may be rotated to various positions relative to the riser body 136.

The rotation block 162 may be generally rectangular shaped, but may include rounded corners 272. The corners 272 may provide an aesthetically appealing appearance, as they may be configured to generally match the curvature of the other top-side portions of the adjustment mechanism 130.

The rotation block 162 may also include one or more fastening apertures 268, 270 defined in the top surface 276. The fastening apertures 268, 270 may receive fasteners 278, 280 (see FIG. 3), which may be used to operably connect the cheek piece 132 to the rotation block 162. Additionally, the rotation block 162 may include a fastening aperture 266 defined in a bottom surface. The fastening aperture 266 may be configured to receive a fastener 302 that may operably connect the biasing member 164 to the rotation block 162.

The rotation block 162 may further include a biasing aperture 264. The biasing aperture 264 may receive at least a portion, if not all, of the biasing member 164. The biasing aperture 264 may be an at least partially ovular shaped aperture that may oriented vertically relative to the rotation block 162, such that the biasing aperture 264 extends between the top surface and the bottom surface. In some embodiments, a first end of the biasing aperture 264 closest towards the top surface 276 may be rounded but the second end of the biasing aperture 264 may be relatively planar. The biasing aperture 264 may have a width sufficient to retain a connection member 298, which may rotatably connect the riser body 136 and the rotation block 162 together. For instance, the connection member 298 may be a pin, which may be inserted through the biasing aperture 264 of the rotation block 162 and the aperture 224 of the riser body 136.

It should be noted that the rotation block 162 and/or locking member 260 may be generally oriented, dimensioned, and shaped as desired depending on the configuration of the riser body 136, rifle 100, desired adjustment, and so on.

Figure 7:
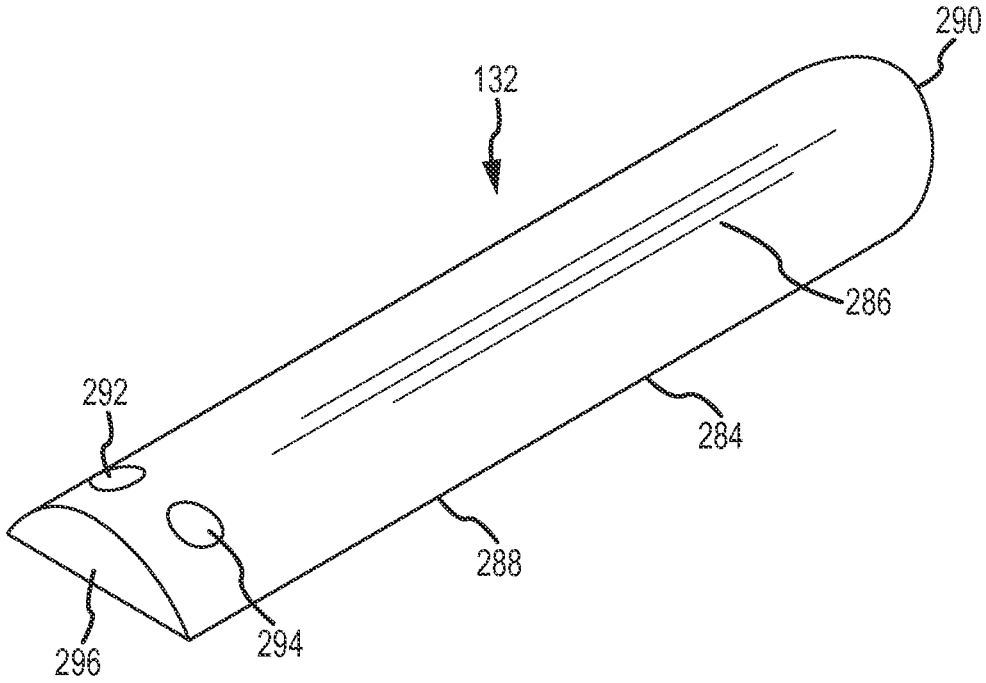
FIG. 7 is a top perspective view of a cheek piece of the adjustment mechanism.

The cheek piece 132 is rotatably connected to the riser body 136 by the rotation block 162. The cheek piece 132 is configured to support a portion of a user's face above a top surface of the rifle 100 and to elevate the user's vision to be aligned with a scope or other optic member that may be operably connected to the rifle 100. FIG. 7 is a top perspective view of the cheek piece 132 removed from the adjustment mechanism 130. With reference to FIGS. 2B, 3, and 7, the cheek piece 132 may include an elongated body 284 having a rounded top surface 286 and a relatively planar bottom surface 288. In other words, the cross-sectional profile of the cheek piece 132 may be half-moon shaped.

The top surface 286 supports a portion of a user's face and the rounded profile may be contoured to the user's face and/or cheek bones. In this manner, the cheek piece 132 may provide support for the user in a comfortable manner, even as the user may alter his or her face orientation along the cheek piece 132. The planar bottom surface 288 may reduce the weight of the cheek piece 123, while still providing the rounded surface for a user's face.

A first end 296 of the cheek piece 132 may be relatively planar and is configured to be in substantially the same plane as the outer surface of the first side 202 of the riser body 136. A second end 290 of the cheek piece 132 may be curved as it transitions from a first side of the cheek piece 132 to a second side of the cheek piece 132.

The cheek piece 132 may also include two fastening apertures 292, 294 configured to receive two fasteners 278, 280 (see FIG. 3). The fastening apertures 292, 294 may be dimensioned so that the fasteners 278, 280 may be recessed from the top surface 286 when positioned within the apertures 292, 294.

With reference again to FIG. 3, the biasing member 164 may include a resilient member 300, such as a coil spring, cantilever spring, leaf spring, or the like. The biasing member 164 may also include an attachment member 302. The attachment member 302 may help to secure the resilient member 300 within the rotation block 162. For example, the attachment member 302 may be a threaded nut or other similar fastener which may be secured to sidewalls of the fastening aperture 266 of the rotation block 162. However, in other embodiments the biasing member 164 may substantially any other element that can provide a biasing force, and may be connected to the rotation block 162 in substantially any manner.

With continued reference to FIG. 3, the adjustment member 130 may also include an adjustment fastener 304. The adjustment fastener 304 is received into the adjustment aperture 206 within the riser body 136 and is operably connected to the butt plate 134 through fastener 166. The adjustment fastener 304 may be positioned at substantially any height of the adjustment aperture 206, and thus allows the butt plate 134 to be operably connected to the riser body 136 at various heights along the height of the riser body 136.

The adjustment plate 136 may further include the mounting plate 138. The mounting plate 138 operably connects the adjustment mechanism 130 to the rifle 100. In other words, the mounting plate 138 may act as an interface between the adjustment mechanism 100 and the rifle, to allow the adjustment mechanism 130 to be connected to the butt of the rifle 100. As such, similar to the butt plate 134, the mounting plate 138 may be varied based on the rifle 100. This may allow a user to attach the adjustment mechanism 130 to various rifles by switching only the mounting plate 138 and/or the butt plate 134, and the other components may remain substantially the same. Of course, in other instances, the adjustment mechanism 130 may be specifically tailored for a particular rifle 100, but in these instances the adjustment mechanism 130 may not be as versatile with respect to interchangeability as the previous embodiments.

Figure 8A:
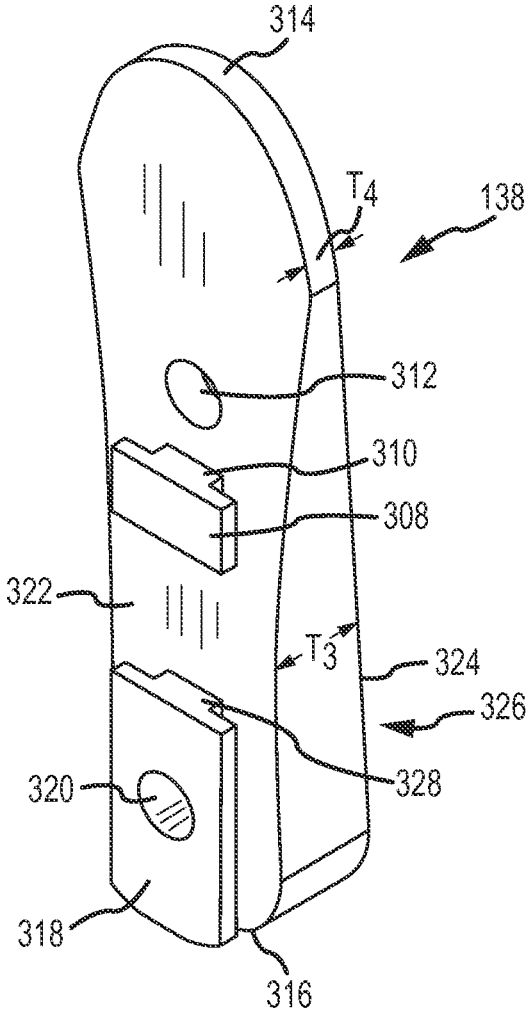
FIG. 8A is a front perspective view of an mounting plate of the adjustment rifle.
Figure 8B:
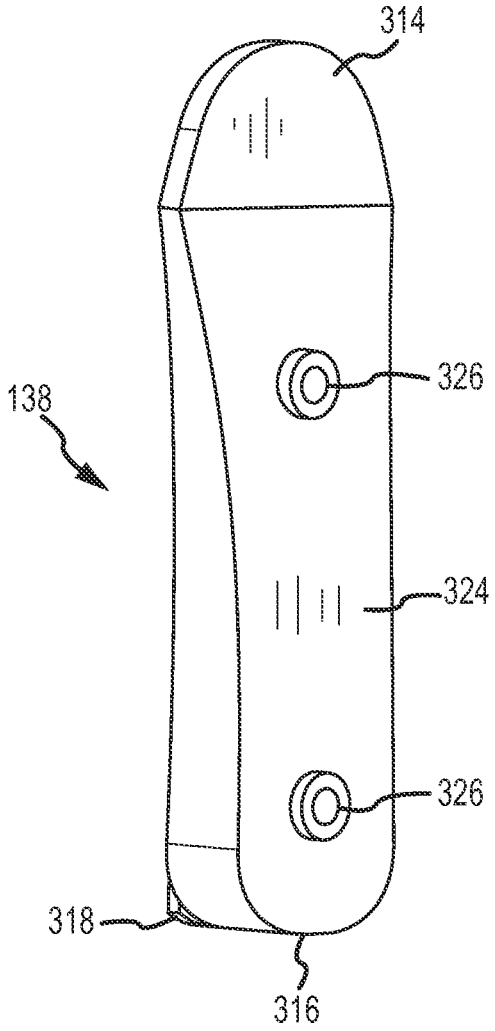
FIG. 8B is a rear perspective view of the mounting plate of FIG. 8A.

A specific non-limiting example of the mounting plate 138 will now be discussed in more detail. FIG. 8A is a front perspective view of the mounting plate 138. FIG. 8B is a rear perspective view of the mounting plate 138. The mounting plate 138 may include a first side 322 which may interface with the riser body 136 and a second side 324 which may interface with the end surface of the butt 106 of the rifle. The mounting plate 138 may generally be configured to contour to the shape of the butt 106 of the rifle 100 so that there may be a relatively seamless transition between the end of the rifle 100 and the adjustment mechanism 130, which may make it more comfortable for a user to hold and use the rifle 100. Similarly, the mounting plate 138 may include attachment means 326, such as apertures, hooks, fasteners, or the like, which may be selected based on the desired rifle 100 for which the adjustment mechanism 130 may attach. In many cases, the rifle 100 may include attachment means for operably connecting the butt pad 140 to the butt 106, in these cases the mounting plate 138 may be configured to have attachment means similar to the butt pad 140, so that the rifle 100 may not need to be substantially modified in order for the adjustment mechanism 130 to be connected thereto.

The first surface 322 of the adjustment plate 136 may include two engaging members 308, 318 that may be operably connected to the riser body 136. The first engaging member 308 may be positioned at or just above a horizontal centerline of the mounting plate 138. The second engaging member 318 may be positioned at a bottom end 316 of the mounting plate 138 and extend upwards, terminating a predetermined distance below the first engaging member 308. Each of the engaging members 308, 318 may be T-shaped in cross-section, in that each may include a narrow base member 310, 328 that expands outwards as it extends away from the first surface 322 of the mounting plate 138. In this way, the engaging members 308, 318 are narrowest at the connection to the first surface 322.

Both engaging members 308, 318 may be received into the adjustment aperture 206 of the riser body 136. In some embodiment, the engaging members 308, 318 may be slid into the adjustment aperture 206 from the bottom end 204 of the riser body 136 upwards. For example, the engaging members 308, 318 may be received into the encompassing recess 210 and then the mounting plate 138 may be slide along the second side of the riser body 136 towards the top end, and the shelf 256 may interlock the engaging members 308, 318 into the adjustment aperture 206. When engaged within the adjustment aperture 206, due to the T-shape of the engaging members 308, 318, the mounting plate 138 may slide vertically relative to the riser body 136, but may not substantially move horizontally relative to the riser late 136.

With continued reference to FIGS. 8A and 8B, the mounting plate 138 may increase in thickness from the top end 314 towards the bottom end 316. For example, a top portion of the mounting plate 138 may have a thickness of T4 and a bottom portion of the mounting plate 138 may have a thickness of T3, where T3 is larger than T4. However, in other embodiments, the mounting plate 138 may have a relatively constant thickness. The variation of the thickness of the mounting plate 138 may be selected based on the surface of the butt 106 of the rifle 100. For example, if the butt 106 is angled, the thickness of the mounting plate 138 may be varied to match or offset the angled surface of the butt 106. However, in instances where the butt 106 may not be angled, the mounting plate 138 may also be not angled to match the butt 106, or the mounting plate 138 may be angled to provide a different orientation for the adjustment mechanism 130.

Assembly of the Adjustment Mechanism

Assembling the adjustment mechanism 130 and operably connecting it to the rifle 100 will now be discussed in more detail. With reference to FIGS. 1A and 3, typically a rifle or other gun may have the butt pad 140 operably connected to an end of the butt 106, and so generally the user may remove the butt pad 140 before connecting the adjustment mechanism 130 to the butt 106. Once the butt pad 140 is removed, the mounting plate 138 may be operably connected to the end of the butt 106 of the rifle 100. As an example, the attachment means 326 may be aligned with corresponding attachment mechanisms on the butt 106 and interlocked or otherwise connected together.

Once the mounting plate 138 is operably connected to the butt 106, the riser body 136 may be operably connected to the mounting plate 138. In one example, the engaging members 308, 318 may be aligned and slid into the adjustment aperture 206 of the riser body 136 from the bottom end 204 of the riser body 136 upwards. For example, the engaging members 308, 318 may be received into the encompassing recess 210 and then the mounting plate 138 may be slide along the second side of the riser body 136 towards the top end, and the shelf 256 may interlock the engaging members 308, 318 into the adjustment aperture 206. The mounting plate 138 may be secured to the butt 106, and then the riser body 136 may be operably connected to the mounting plate 138. For example, one or more fasteners, such as the fastener 250, 306 may be used to secure the mounting plate 138 to the butt 106 and/or secure the riser body 136 to the mounting plate 138.

Once the riser body 136 and the mounting plate 138 are operably connected to the rifle 100, the butt plate 134 may be connected. In some instances, a user may vary the position and/or orientation of the butt plate 134 prior to securing the butt plate 134 to the riser body 136. For example, the adjustment fastener 304 may be released to allow the butt plate 134 to be rotated and/or moved vertically to a desired position, and after the butt plate 134 is positioned in the desired position, the adjustment fastener 304 may be secured, for example, with fastener 166, to secure the butt plate 134. Once the butt plate 134 is in the desired position, the butt pad 140 may be operably connected to the butt plate 134. Connecting the butt pad 140 to the butt plate 134 may depend on the butt pad 140, but may use one or more fasteners, or the like to operably connect the two components together.

Operation of the Adjust Mechanism

Operation of the adjustment mechanism 130 will now be discussed in more detail. In the support position, the cheek rest 132 may be oriented so as to extend along a top surface of the rifle 100. This may provide a support surface for a portion of the user's face while the user is viewing through an optic (such as a scope) or other alignment/aiming tool for the rifle 100. Additionally, the cheek piece 132 may be elevated over the surface of the rifle 100 to support the user's face or portions thereof higher above the top surface of the rifle 100. In some instances, for example, with removable optic scopes, the scope may be elevated off of the surface of the rifle 100 and it may be difficult for a user to maintain his or her aiming alignment since his or her cheek may not have a support surface. In these instances, because the cheek piece 132 is elevated, the user may be able to support his or her face while at the same time aligning with an elevated scope. Further, the height of the cheek piece 132 may be varied by changing a location of the rotation block within the riser body, and thus the elevation height of the cheek piece may be set as desired by the user.

Figure 9:
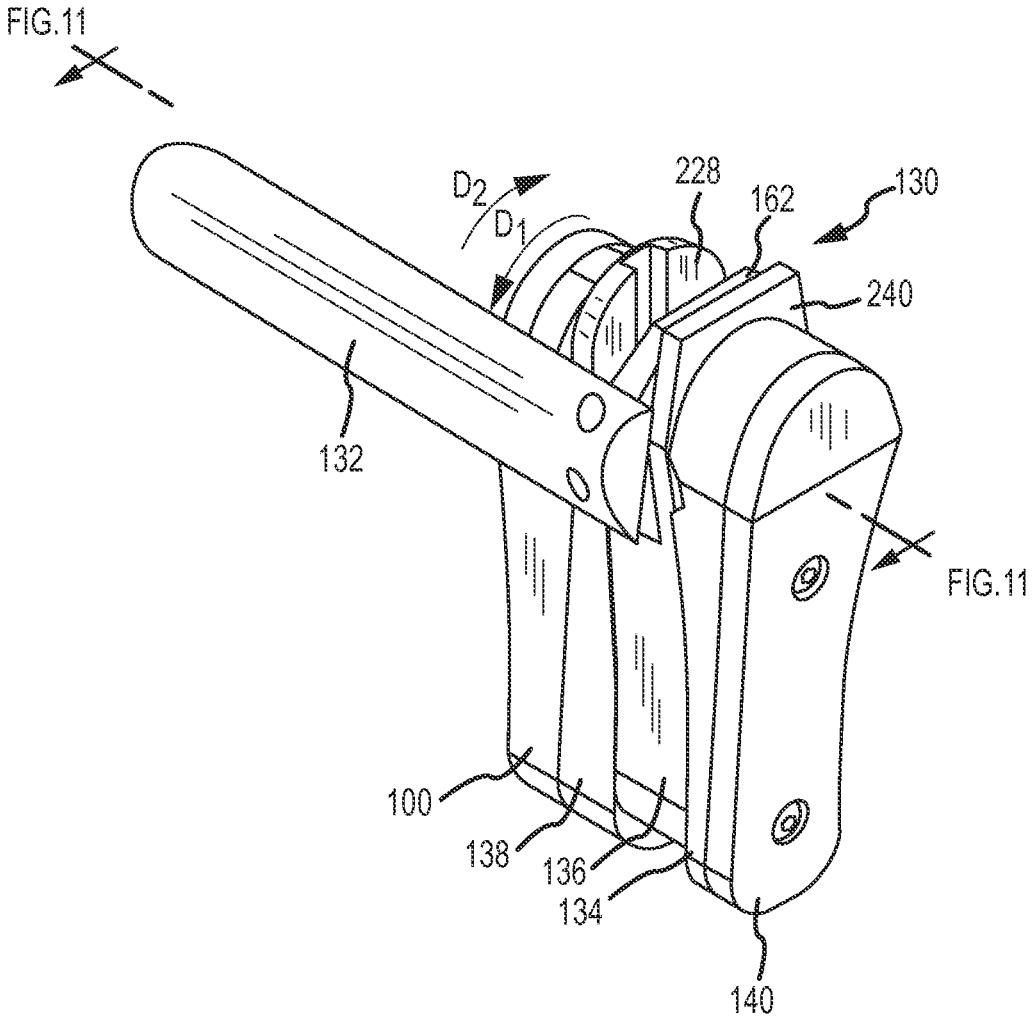
FIG. 9 is a side perspective view of the adjustment mechanism with the cheek piece rotated from a support position to a release position.
Figure 10:
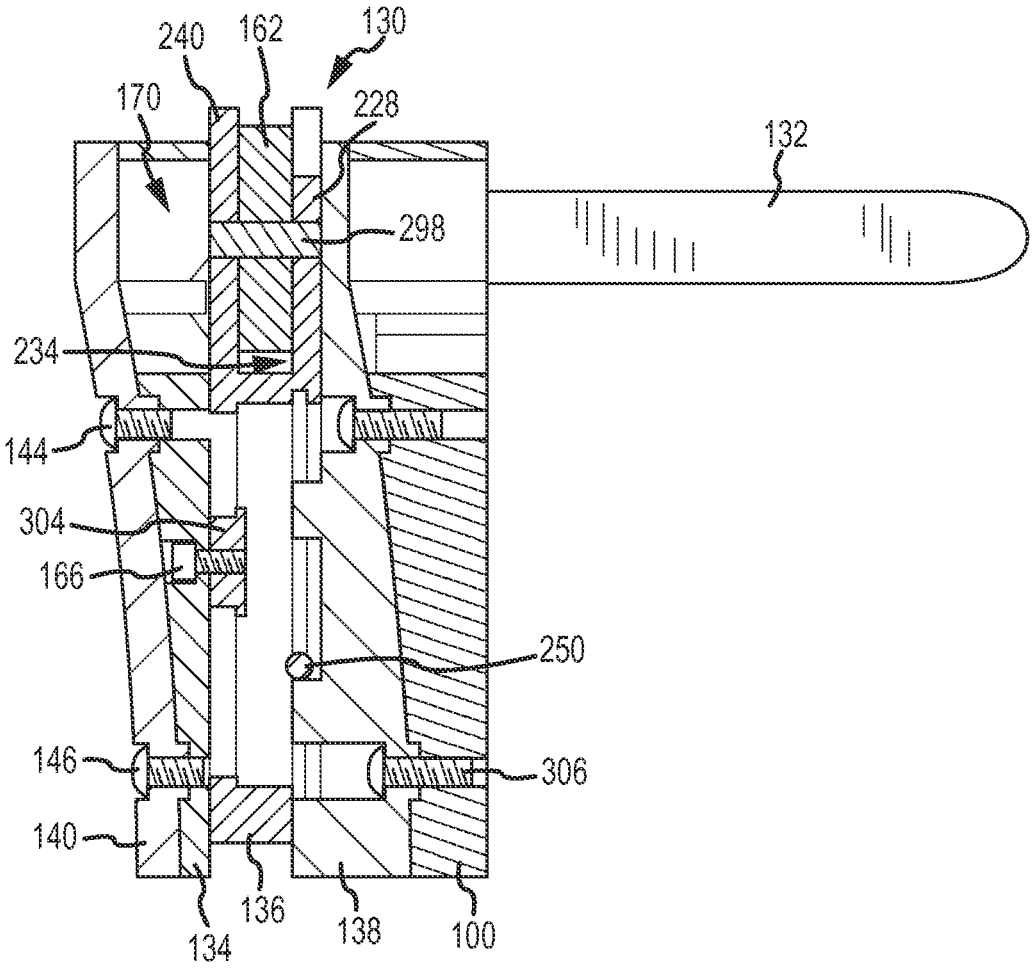
FIG. 10 is a cross-section view of the adjustment mechanism with the cheek piece in the release position taken along line 10-10 in FIG. 9.

Often a user may want to switch from a scope or other removable optic to the alignment tool incorporated into the rifle 100, e.g., the two sights 114, 116. For example, if a user is switching between a long distance target and a closer target. In the position shown in FIG. 1A, the cheek piece may elevate a user's face (and specifically his or her eye) above a desired level for using the sights 114, 116. In these instances, the user can rotate the cheek piece 132 to a release position where it may not substantially interfere with a user's aiming of the rifle 100. FIG. 9 is a side perspective view of the adjustment mechanism 130 with the cheek piece 132 rotated from a support position (FIG. 2A) to a release or second position. FIG. 10 is a cross-section view of the adjustment mechanism 130 taken along line 10-10 in FIG. 9. In some instances, the cheek piece 132 may rotate between 70 to 120 degrees from a centerline of the riser body, in either the right or left directions. In a specific embodiment, the cheek support may rotate approximately 90 degrees in either or both the left and right directions.

As described above, the rotation block 162 may be secured in the riser body 136 by the locking member 260 interacting with the rounded features 232 of the lowering aperture 226. Additionally, the biasing member 164 may bias the rotation block 162 into the support position, so that the cheek piece 132 may be substantially prevented from moving while in the support position. Accordingly, to rotate the rotation block 162 and thus rotate the cheek piece 132, a user provides a force sufficient to overcome the biasing force and lift the rotation block 162 out from engagement with the rounded features 132. The user may continue to provide an upwards force and pull the rotation block 162 out of the adjustment cavity 234. Once removed, the user can rotate the rotation block 162 with a reduced force in either direction D1 or direction D2, depending on which side of the rifle 100 the user would prefer to have the cheek piece 132 located in the release position.

It should be noted that in some embodiments, the shoulders 242, 244 and the detents 246, 248 may limit the rotation of the rotation block 162. Additionally, in some embodiments, the detents 246, 248 may also function to, at least temporarily, secure the rotation block 162 in the rotated position. For example, when the rotation block 162 is aligned with a particular detent 246, 248, the interlocking members 262 of the locking member 260 may be received into the detents 246, 248 to secure the rotation block 162 in the particular position. In some examples, the adjustment mechanism 130 may include two or more detents and shoulders positioned along various locations of the riser body 136 so that the rotation block 162 may be secured at a number of different locations along the rotation directions D1, D2.

In the release position, such as shown in FIGS. 9 and 10, the cheek piece 132 may extend along a side of the rifle 100. The cheek piece 132 may be held in place by the rotation block 162 engaging with the detents 246, 248 of the riser body 138. In the release position, the cheek piece 132 may be prevented from substantially interfering with a user's vision along a top surface of the rifle (e.g., through the sights 114, 116), but may still remain easily movable to the support position in the event that the user may quickly need to aim the rifle 100 using a scope or other optic.

To transition the cheek piece 132 from the release position back to the support position, the user may provide a force sufficient to disengage the interlocking features 262 with the detents 246, 248 and provide a force in a direction towards the top surface of the rifle 100. Once the rotation block 162 is positioned over the lowering aperture 226, the biasing member 164 may provide a force downwards, lowering the rotation block 162 into the adjustment cavity 234.

Figure 11:
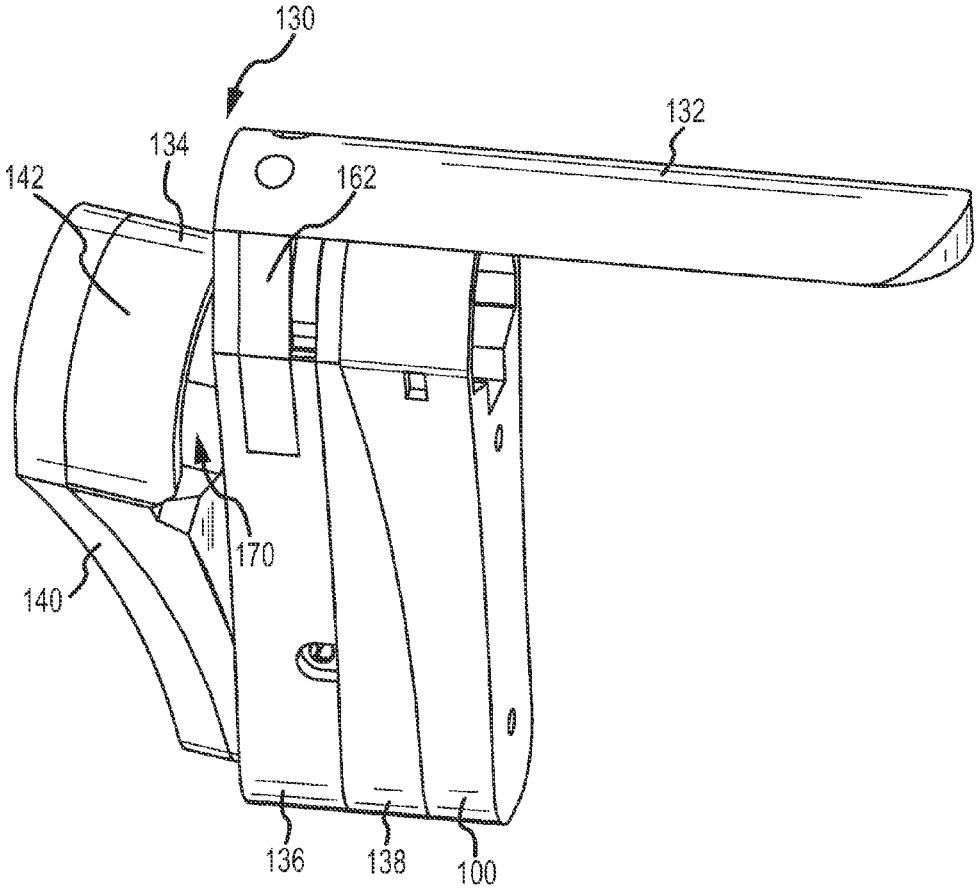
FIG. 11 is a top perspective view of the adjustment mechanism with the butt plate rotated from a first position to a second position.
Figure 12:
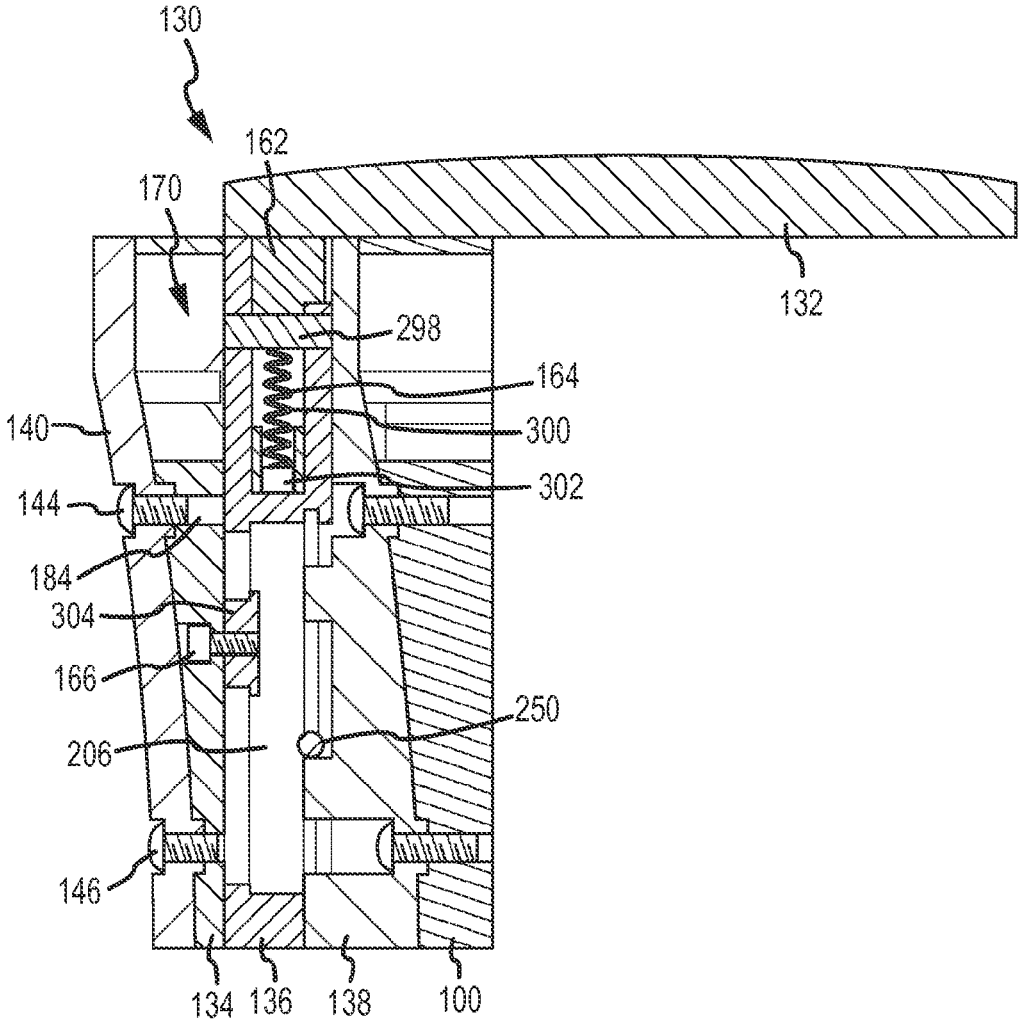
FIG. 12 is a cross-sectional view of the adjustment mechanism taken along line 12-12 in FIG. 11.

In addition to rotating the cheek piece 132 between one or more positions, the adjustment mechanism 130 may provide further customization by allowing the butt pad 140 to be rotated as well. FIG. 11 is a perspective view of the butt pad 140 and butt plate 134 rotated to an adjusted position. FIG. 12 is a cross-sectional view of the adjustment mechanism 130 taken along line 11-11 in FIG. 12. The butt plate 134 operably connects the butt pad 140 to the adjustment mechanism 130, and the butt plate 134 may be rotated and secured in substantially any orientation relative to the riser body 136.

With reference to FIG. 2A, in a first or aligned position, the top end 142 of the butt plate 134 may be aligned with the top surface of the riser body 136 and the top end of the mounting plate 138. With reference to FIG. 11, in a second or adjusted position, the top end 142 of the butt plate 134 may be offset from the top end of the riser body 136 and the top end of the mounting plate 138. Additionally, the bottom end of the butt plate 134 may also be rotated out of alignment with the riser body 136 and the mounting plate 138.

To vary the height of the butt plate 134 and thus the butt pad 140, the adjustment fasteners 304 may be moved along a height of the adjustment aperture 206. Once the desired position is reached, the fasteners 166 may be received into the adjustment fastener 304, securing the adjustment fastener 304 in place along the adjustment aperture 206. Additionally, the butt plate 134 may be rotated to various angles relative to the adjustment mechanism 130 and butt 106 of the rifle 100. Before the fastener 166 is tightened or otherwise secured in the adjustment fastener 304, the butt plate 134 may be rotated to a desired position. As shown in FIG. 11, in some instances the butt plate 134 may be rotated so that the top and bottom ends may extend past the sides of the adjustment mechanism 130. Because the butt plate 134 may adjust the height and orientation of the butt pad 140, the adjustment mechanism 130 may provide an enhanced experience with the rifle 100 by allowing the user to increase comfort in the placement of the butt pad 140 so as to be best suited for the environment and his or her own body characteristics (e.g., shoulder pocket shape, anatomy, arm length, and so on).

Alternative Embodiments

Figure 13:
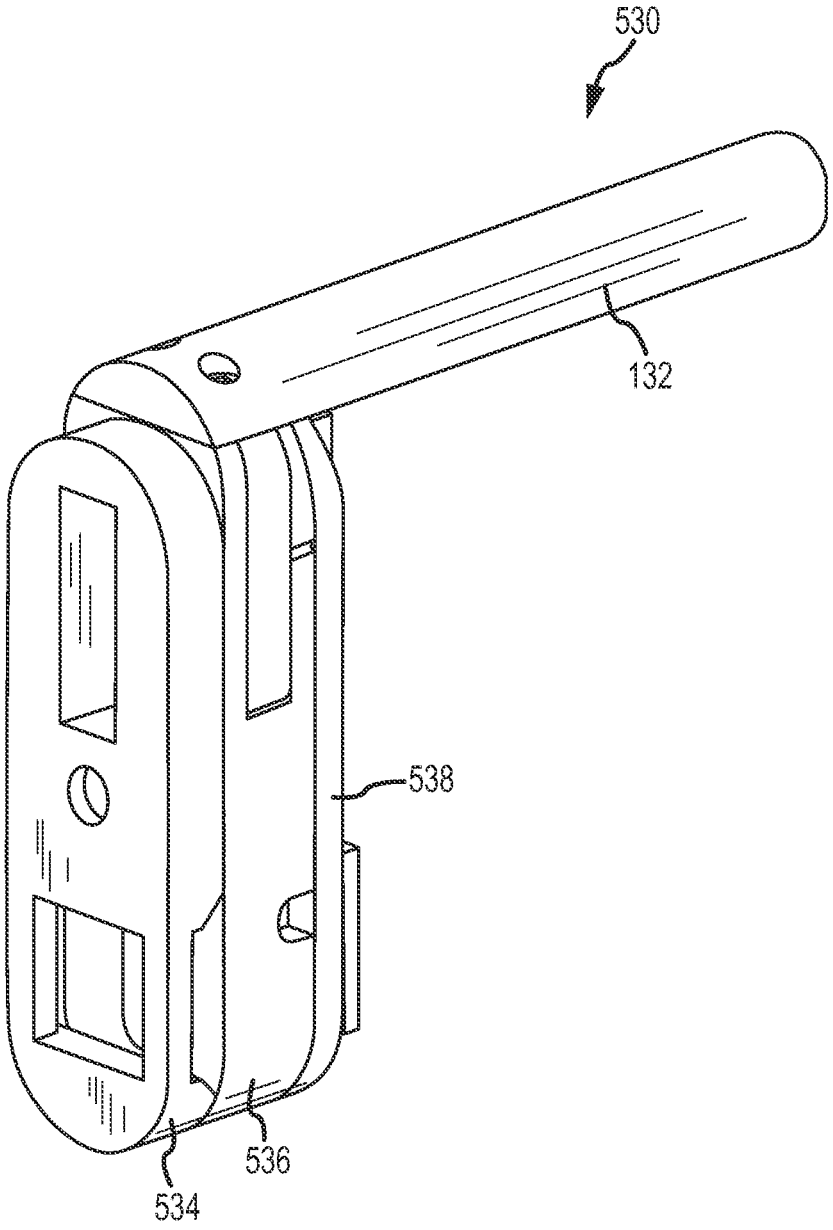
FIG. 13 is a rear perspective view of another example of an adjustment mechanism for handheld weapons.
Figure 14:
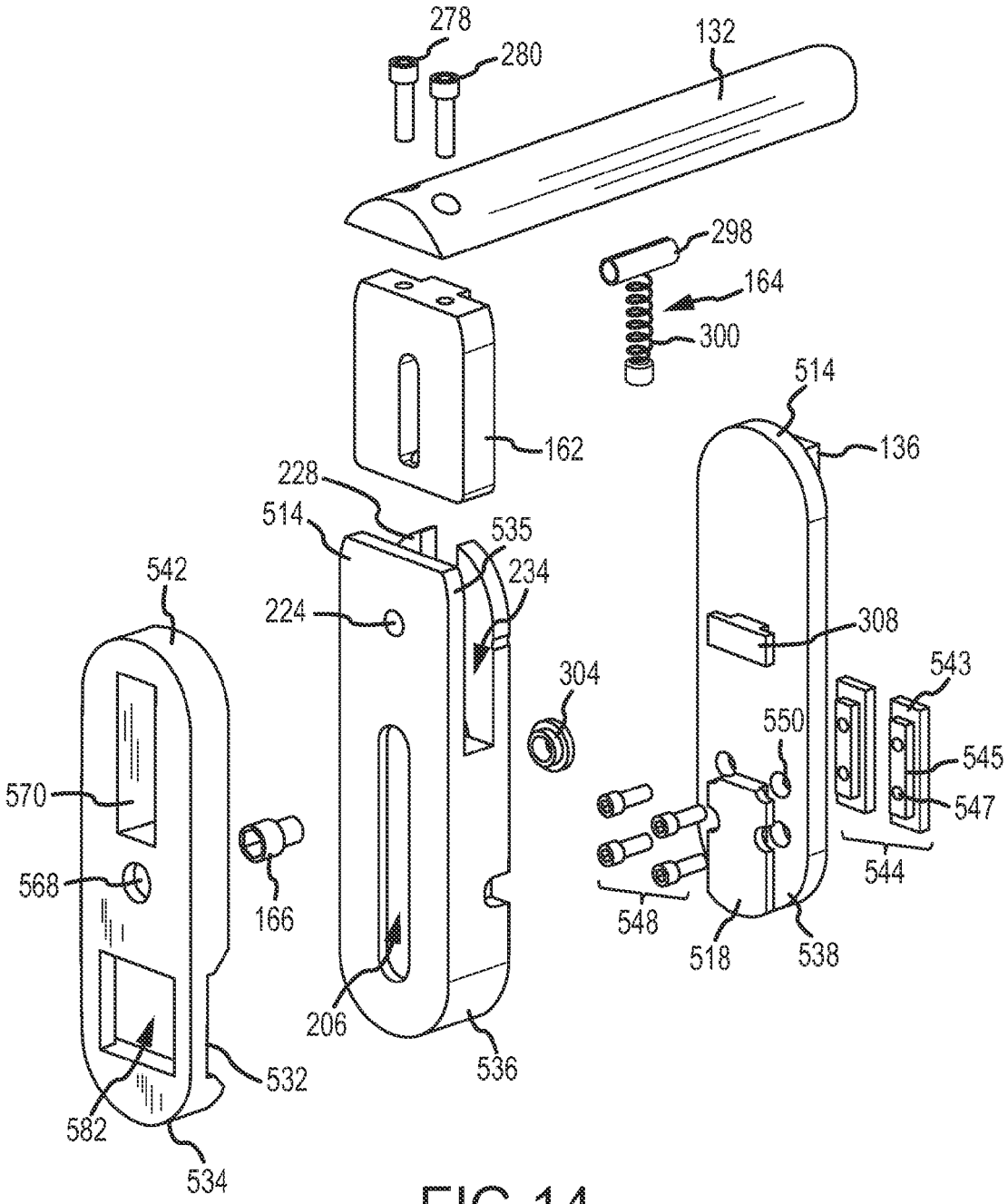
FIG. 14 is an exploded view of the adjustment mechanism of FIG. 13.

As discussed above, the butt plate 134 and/or the mounting plate 138 may be varied to accommodate different rifles 100 and/or other weapons. FIG. 13 is a side perspective view of another example of the adjustment mechanism 530. FIG. 14 is an exploded view of the adjustment mechanism of FIG. 13. The adjustment mechanism 530 of FIGS. 13 and 14 may be substantially similar to the adjustment mechanism 130. However, the adjustment mechanism 530 may have a differently shaped riser body 536, as well as a differently shaped mounting plate 538 and butt plate 534. The mounting plate 538 and/or butt plate 534 may be configured to operably connect to different type of rifle butt 106 and butt pad 140, respectively.

With respect to FIG. 14, the butt plate 534 may have a top end 542 and a bottom end 534 and include two connection apertures 570, 582 which may be configured to receive one or more connection members for a butt pad (not shown). Accordingly, although the first connection aperture 570 is illustrated as a rectangular shaped aperture extending vertically and the second connection aperture 582 is shaped generally as square aperture, the shapes of the aperture 570, 582 may be varied based on the butt pad which may be connected to the butt plate 134. For example, different butt pads may include different connection means for attaching to the butt of the rifle, and the butt plate 134 may include attachment members, such as connection apertures 570, 582, to connect to the members of the butt pad. The butt plate 534 may also include a fastening aperture 568 for receiving fastener 166 to operably connect the butt plate 534 to the riser body 536.

The butt plate 534 may further include one or more recesses 532 on a rear side. The recesses 532 may be used to receive portion of the butt pad 140, as well as reduce weight of butt plate 534. In some instances, the recesses 532 may form beveled edges along the sidewalls defining the second connection aperture 582.

The riser body 536 may be substantially similar to the riser body 136. However, in this embodiment, the riser body 536 may include a relatively rectangular top portion 514 that includes rounded corners 535. The rounded corners 535 may allow the rotation block 162 to more easily slide around the riser body 536 when rotated by a user.

With continued reference to FIG. 14, the mounting plate 538 may also be similar to the mounting plate 138, but may include differently shaped attachment means 136, 544, 548. For example the mounting plate 538 may include a first attachment member 136, which may be a tab extending from a top rear surface of the plate 538. The attachment member 136 may be configured to be received in an aperture (not shown) of the butt 106, such as an aperture configured to receive a portion of a butt pad 140. For example, the tab 136 may include a hook-like shape that may curve or bend upwards to be received in a detent or aperture further defined in the rifle 100.

The other attachment members 544, 548 may be removable from the adjustment mechanism 530. For example, two connection elements 544, such as blocks, tabs, or fingers, may be operably connected to the mounting plate 538 via four fasteners 548. The connection elements 544 may include a rectangular shaped main body 543 with an extension member 545, which may have a smaller height and/or width than the main body 543 extending from one side of the main body 543. The extension members 545 may act to extend the distance of the main body 543 out from the surface of the plate 538. For example, in cross-section the connection elements 544 may have a generally "T" shaped appearance. Two receiving apertures 547 may be defined in each extension member 545 and/or main body 543 to receive the fasteners 548.

The attachment members 544 may be used to attach the adjustment mechanism 530 to the butt 106 of the rifle 100. For example, the butt 106 may include one more receiving apertures, and the attachment members 544 may be received in the apertures, which the portions of the main body 543 wider than the extension members 545 extend over a sidewall defining the receiving apertures, to secure the mounting plate 538 to the butt 106. However, it should be noted that substantially any other number of attachment means may be used to connect the adjustment mechanism 530 to the butt 106 of a rifle 100, e.g., screws, adhesive, hook and loop, and so on.

It should be noted that generally the components as described herein may be manufactured in a number of different manners. Some illustrative examples include machining, injection molding, and/or casted. Moreover, each of the various components may be manufactured with a variety of materials. Some illustrative materials include, plastics, polymers, metal alloys, metals, or combinations of one or more materials.

Conclusion

The foregoing description has broad application. For example, while examples disclosed herein may focus on or methods relating to certain rifles, it should be appreciated that the concepts disclosed herein may equally apply to other types of weapons which may use an optical sight. Similarly, although the particular configurations for the mounting plate and butt plate may be discussed, these components may be varied based on the shape, model, and manufacturer of a weapon which may be used with the adjustment mechanism. Accordingly, the discussion of any embodiment is meant only to be exemplary and is not intended to suggest that the scope of the disclosure, including the claims, is limited to these examples.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. The exemplary drawings are for purposes of illustration only and the dimensions, positions, order and relative sizes reflected in the drawings attached hereto may vary

What is claimed is:

1. An adjustment mechanism for a rifle comprising:

a riser body configured to be operably connected to a butt end of the rifle;

a butt plate rotatably connected to the riser body, the butt plate configured to be selectively rotated between at least a first position and a second position relative to the riser body; and a cheek piece rotatably supported above the riser body and selectively rotatable relative to the riser body between a support position and a release position; wherein in the support position the cheek piece extends along a top surface of the rifle and in the release position the extends along a side of the rifle.

2. The adjustment mechanism of claim 1, wherein the butt plate is configured to be operably connected to a butt pad.

3. The adjustment mechanism of claim 1, wherein in the first position, a top end of the butt plate is substantially aligned with a top end of the riser body, and in the second position the top end of the butt plate is offset from the top end of the riser body.

4. The adjustment mechanism of claim 1, further comprising a rotation block operably connected to the cheek piece and rotatably connected to the riser body, wherein the rotation block rotates relative to the riser body to selectively rotate the cheek piece between the support position and the release position.

5. The adjustment mechanism of claim 4, wherein the rotation block is biased in a first direction to bias the cheek piece towards the support position.

6. The adjustment mechanism of claim 4, wherein the riser body further includes an engagement feature; and the rotation block further includes a locking feature, wherein in the support position, the locking feature is engaged with the engagement feature; and in the release position, the locking feature is disengaged with the engagement feature.

7. The adjustment mechanism of claim 6, further comprising a biasing member operably connected to the rotation block and the riser body and configured to bias the rotation block in the support position.

8. The adjustment mechanism of claim 1, further comprising an mounting plate operably connected to the riser body and configured to operably connect to the butt of the rifle.

9. The adjustment mechanism of claim 8, wherein the riser body is sandwiched between the butt plate and the mounting plate.

10. A rifle accessory configured to be selectively connected to a rifle, comprising:

a main body configured to be operably connected to the rifle, the main body defining an adjustment aperture extending along a portion of a height of the main body;

a cheek support having a length rotatably connected to the main body; wherein in a support position the length of the cheek support extends substantially parallel to a top surface of the rifle; and in a release position, the length of the cheek support extends substantially parallel to a side surface of the rifle;

a butt plate operably connected to the main body; and an adjustment fastener received through the adjustment aperture to secure the butt plate to the main body at a position along the height of the adjustment aperture; wherein the butt plate is selectively rotatable relative to the main body and can be operably connected to the main body along a range of heights in order to alter the height of the butt plate relative to the rifle; and the adjustment aperture defines the range of heights to alter the height of the butt plate.

11. The rifle accessory of claim 10, wherein the cheek piece rotates approximately 90 degrees between the support position and the release position.

12. The rifle accessory of claim 10, wherein the cheek support has an arcuate top surface.

13. The rifle accessory of claim 10, wherein the butt plate is configured to be operably connected to a butt pad.

14. The rifle accessory of claim 10, further comprising a rotation member operably connected to the cheek piece and rotatably connected to the main body, wherein a first position of the rotation member corresponds to the support position of the cheek piece and a second position of the rotation member corresponds to the release position of the cheek piece.

15. The rifle accessory of claim 14, further comprising a biasing member operably connected to the rotation member and the main body, wherein the biasing member biases the rotation member in the first position.

16. The rifle accessory of claim 14, wherein the main body further includes at least one detent along a rotation path of the rotation member, wherein the detent substantially prevents the rotation member from rotating past the detent.

17. The rifle accessory of claim 14, wherein the biasing member is a coil spring.

* * * * *